US009257796B1

(12) United States Patent
Dang

(10) Patent No.: US 9,257,796 B1
(45) Date of Patent: Feb. 9, 2016

(54) ELECTRICAL CONNECTOR FOR HIGH-SPEED TRANSMISSION USING TWISTED-PAIR CABLE

(71) Applicant: Glenair, Inc., Glendale, CA (US)

(72) Inventor: Phong Dang, Auburn, WA (US)

(73) Assignee: Glenair, Inc., Glendale, CA (US)

( * ) Notice: Subject to any disclaimer, the term of this patent is extended or adjusted under 35 U.S.C. 154(b) by 0 days.

(21) Appl. No.: 14/617,915

(22) Filed: Feb. 9, 2015

(51) Int. Cl.

| | |
|---|---|
| ***H01R 13/648*** | (2006.01) |
| ***H01R 13/6585*** | (2011.01) |
| ***H01R 43/16*** | (2006.01) |
| ***H01R 13/6463*** | (2011.01) |

(52) U.S. Cl.
CPC ..... *H01R 13/6585* (2013.01); *H01R 13/6463* (2013.01); *H01R 43/16* (2013.01)

(58) Field of Classification Search
USPC ..... 439/607.05
See application file for complete search history.

(56) References Cited

U.S. PATENT DOCUMENTS

| | | | | |
|---|---|---|---|---|
| 7,316,584 | B2 * | 1/2008 | Mackillop | H01R 13/6477 439/607.05 |
| 8,764,471 | B2 | 7/2014 | Dang | |
| 2011/0189878 | A1 * | 8/2011 | Rogers | H01R 13/52 439/271 |
| 2014/0120769 | A1 | 5/2014 | Dang | |
| 2015/0270647 | A1 * | 9/2015 | Hoher | H01R 9/038 439/607.05 |

* cited by examiner

*Primary Examiner* — Tho D Ta
(74) *Attorney, Agent, or Firm* — David S. Alavi

(57) ABSTRACT

An electrical connector for a shielded, twisted-pair cable comprises a conductive isolator body, multiple conductive contacts, inner and outer insulators, and inner and outer ferrules. The isolator provides electrical shielding and isolation for the contacts and untwisted portions of the wires connected to the contacts. The inner and outer insulators prevent contact between the contacts and between the contacts and the isolator, an outer shell, or a connector insert. The inner ferrule maintains electrical contact between the isolator and the shielding sheath of the cable. The outer ferrule retains the inner ferrule in place and can establish continuity between the isolator and the outer shell or connector insert.

28 Claims, 20 Drawing Sheets

ELECTRICAL CONNECTOR FOR HIGH-SPEED TRANSMISSION USING TWISTED-PAIR CABLE

FIELD OF THE INVENTION

The field of the present invention relates to electrical connectors for high-speed-transmission twisted-pair electrical cables.

BACKGROUND

A wide variety of electrical connectors are available for terminating cables comprising multiple independent conductive wires, including twisted pairs of wires. Some of these are disclosed in:

U.S. Pat. No. 7,316,584 entitled "Matched impedance shielded pair interconnection system for high reliability applications" issued Jan. 8, 2008 to Mackillop et al;

U.S. Pat. No. 8,764,471 entitled "Electrical connector for high-speed data transmission" issued Jul. 1, 2014 to Dang; and U.S. Pat. Pub. No. 2014/0120769 entitled "High density sealed electrical connector with multiple shielding strain relief devices" published May 1, 2014 in the name of Dang.

The general problems of interference, noise, crosstalk, and attenuation that arise when high-speed signals are transmitted through cables and their connectors are common and well known, are described at varying levels of detail in some of the references cited above, and need not be repeated here. Problems related to reliability and reparability of electrical connectors used in such applications also are common.

SUMMARY

An electrical connector for a shielded cable having N twisted pairs of wires comprises: (a) an electrically conductive isolator body, (b) an inner insulator, (c) 2N elongated, electrically conductive contacts, (d) an outer insulator, (e) an inner ferrule, and (f) an outer ferrule. In one typical application, the cable includes four twisted pairs of wires (i.e., N equals four).

The isolator body includes a forward segment and a rearward segment. The rearward segment includes N longitudinally extending channels with open ends for receiving untwisted terminal segments the N pairs of wires of the cable. The forward segment includes a forward-extending central portion and N ribs extending radially from the central portion and extending forward from the rearward segment to a forward end of the connector. Each one of the ribs separates adjacent forward openings of the channels so as to enable the untwisted terminal segment of the corresponding pair of wires received through each channel to extend forward between corresponding adjacent ribs.

The inner insulator is structurally arranged to form (i) a rearward-facing open cavity, (ii) a hole through a forward end wall of the cavity, (iii) N slots extending radially from the cavity to an outer surface, and (iv) N pairs of longitudinally extending grooves on the outer surface. The rearward-facing open cavity is arranged to receive therein at least a forward portion of the forward segment of the isolator body. The hole through the forward end wall of the cavity is arranged to receive therethrough a forward end of the central portion of the isolator body. Each of the N slots is arranged to receive therethrough a corresponding one of the ribs of the isolator body. Each pair of grooves is positioned between an adjacent pair of slots and have open forward and rearward ends.

Each one of the 2N elongated, electrically conductive contacts (pins in a plug-type connector, sockets in a receptacle-type connector) is received in a corresponding one of the grooves, (i) so as to be electrically isolated from the isolator body and the other contacts, and (ii) with an open rearward end of the contact structurally arranged at the open rearward end of the corresponding groove to receive and secure a stripped forward end of a corresponding one of the 2N wires received through the channels.

The outer insulator is arranged to form (i) a rearward-facing open cavity arranged to receive therein at least portions of the inner insulator, each one of the contacts, and the forward segment of the isolator body received within the inner insulator; those portions are circumferentially surrounded by lateral walls of the cavity. An opening through the forward end wall of the cavity is arranged to receive therethrough the forward end of the central portion of the isolator body and forward ends of the ribs of the isolator body that protrude forward from the outer insulator. 2N holes through the forward end wall of the cavity are arranged to align with the open forward ends of the grooves of the inner insulator.

The inner ferrule is structurally arranged to at least partly circumferentially encompass at least a rearward portion of the rearward segment of the isolator body with a forward end of the shielding sheath of the cable between the inner ferrule and the isolator body and in electrical contact with the isolator body. The outer ferrule is structurally arranged to retain the inner ferrule on the rearward segment of the isolator body and to urge the inner ferrule inward toward the rearward segment of the isolator body with the forward end of the shielding sheath against the rearward segment of the isolator body, thereby retaining the shielding sheath on the rearward segment of the isolator body.

A method for terminating a shielded cable having N twisted pairs of wires with any inventive connector disclosed herein comprises: (a) inserting a terminal end of the cable first through the outer ferrule and then through the inner ferrule, and sliding the outer and inner ferrules along the cable away from a terminal segment thereof; (b) after step (a), stripping the insulating sheath from the terminal segment of the cable, folding back the shielding sheath of the terminal segment of the cable, untwisting the twisted pairs of the wires of the terminal segment of the cable, and stripping forward ends of the wires; (c) after step (b), inserting the untwisted portions of each pair of the wires through a corresponding one of the channels through the rearward segment of the isolator body; (d) inserting each one of the contacts into the corresponding one of the grooves of the inner insulator and inserting the forward segment of the isolator body into the rearward-facing cavity of the inner insulator; (e) after step (c), securing the stripped forward end of each one of the wires within the open rearward end of the corresponding one of the contacts; (g) after step (c), unfolding the folded-back terminal segment of the shielding sheath and extending that terminal segment forward around at least a rearward portion of the rearward segment of the isolator body; (h) sliding the inner ferrule forward and over at least the rearward portion of the rearward segment of the isolator body with the terminal segment of the shielding sheath between the inner ferrule and the isolator body; and (i) sliding the outer ferrule forward and engaging the outer ferrule with an outer shell, a connector insert, or a connector housing so that the outer ferrule retains the inner ferrule on the rearward segment of the isolator body and urges the inner ferrule inward toward the rearward segment of the isolator body with the forward end of the shielding sheath against the rearward segment of the isolator body, thereby retaining the shielding sheath on the rearward segment of the isolator body.

Objects and advantages pertaining to electrical connectors for high-speed transmission may become apparent upon referring to the example embodiments illustrated in the drawings and disclosed in the following written description or appended claims.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The embodiments depicted are shown only schematically: all features may not be shown in full detail or in proper proportion, certain features or structures may be exaggerated relative to others for clarity, and the drawings should not be regarded as being to scale. The embodiments shown are only examples: they should not be construed as limiting the scope of the present disclosure or appended claims.

DETAILED DESCRIPTION OF EMBODIMENTS

Figure 1A:
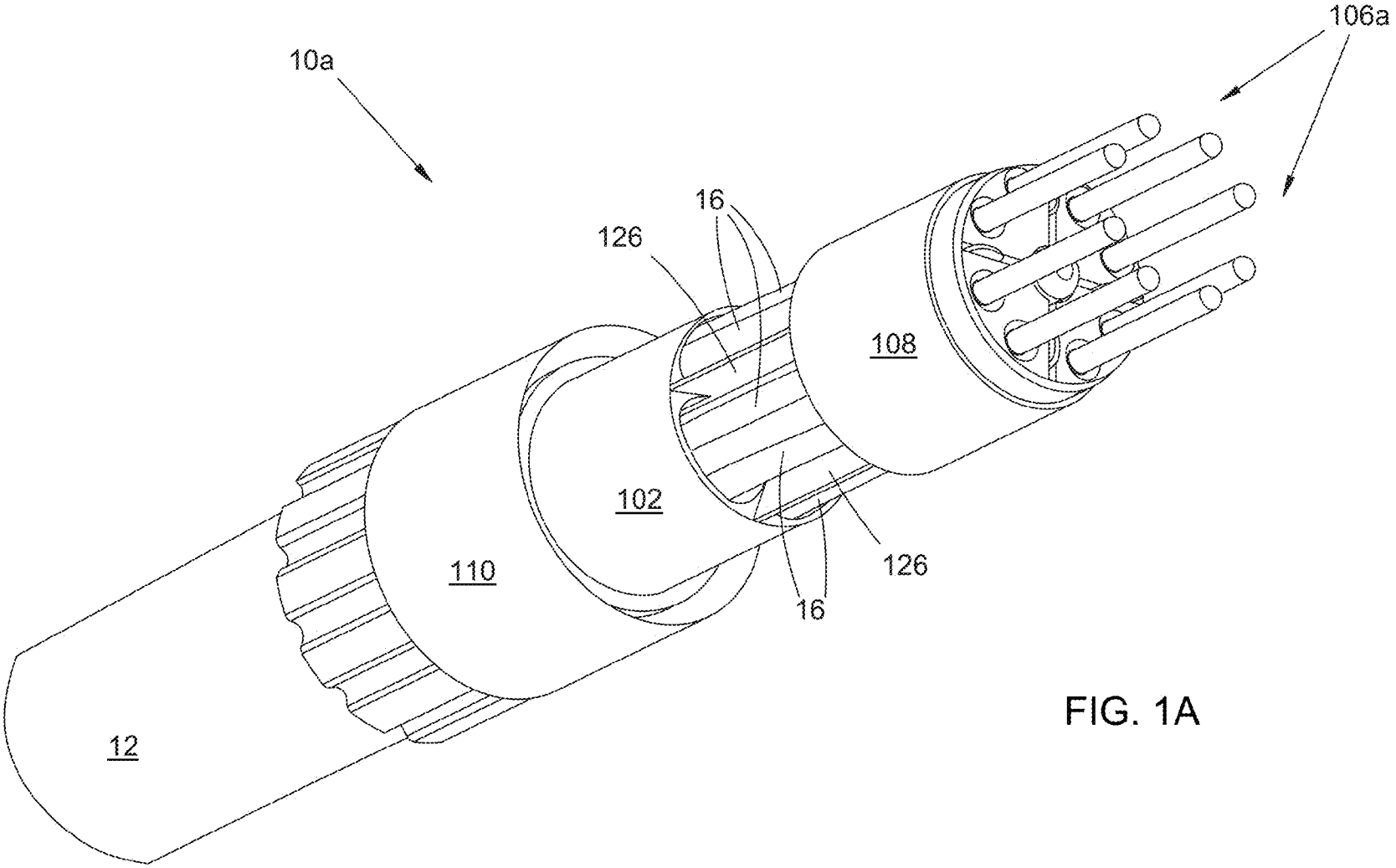
FIGS. 1A and 1B illustrate schematically an example plug-type connector for a cable comprising four twisted pairs. The outer ferrule and outer insulator are removed in FIG. 1B, and the inner ferrule is slightly rearward of its final position upon assembly.
Figure 1B:
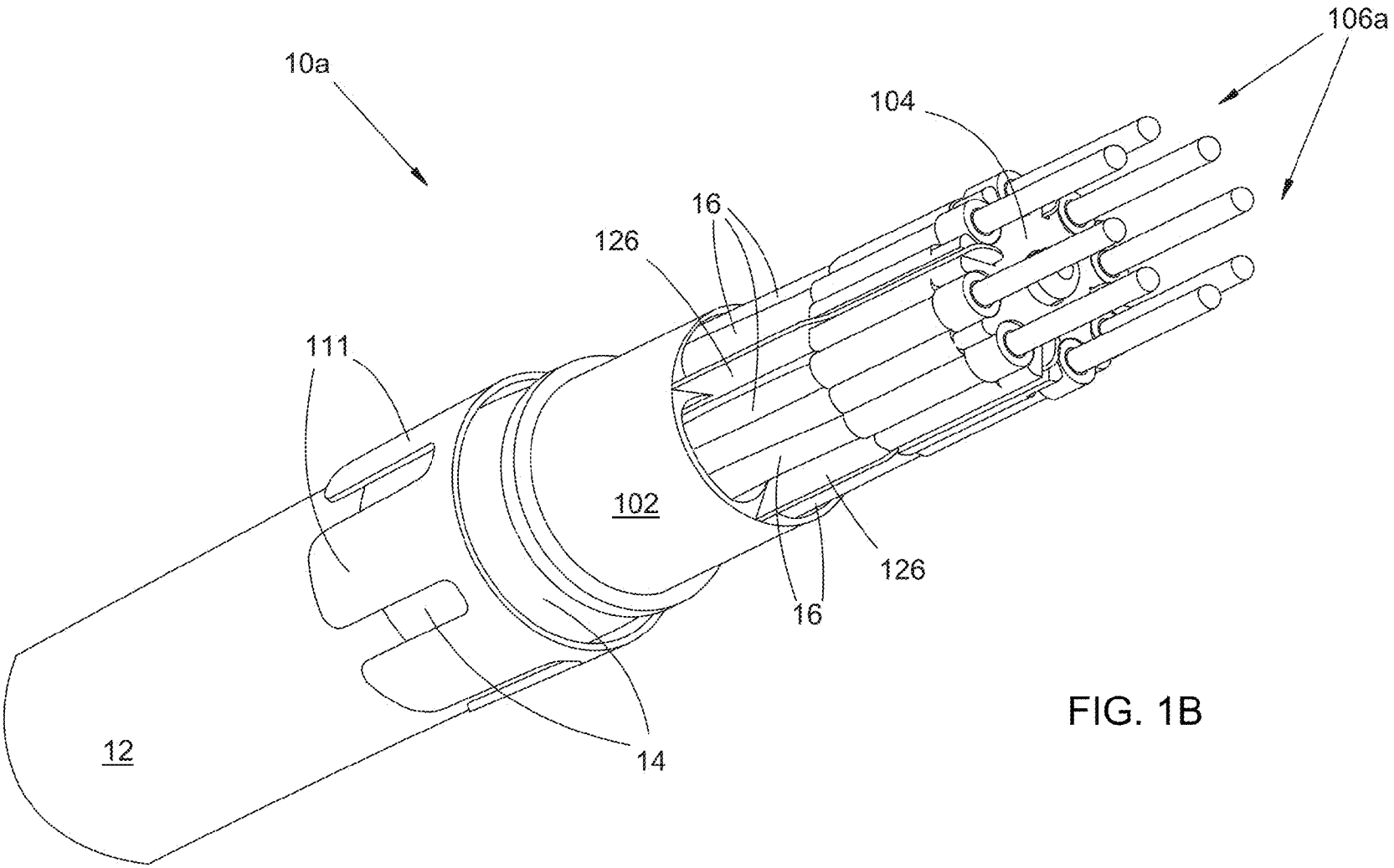
Figure 2:
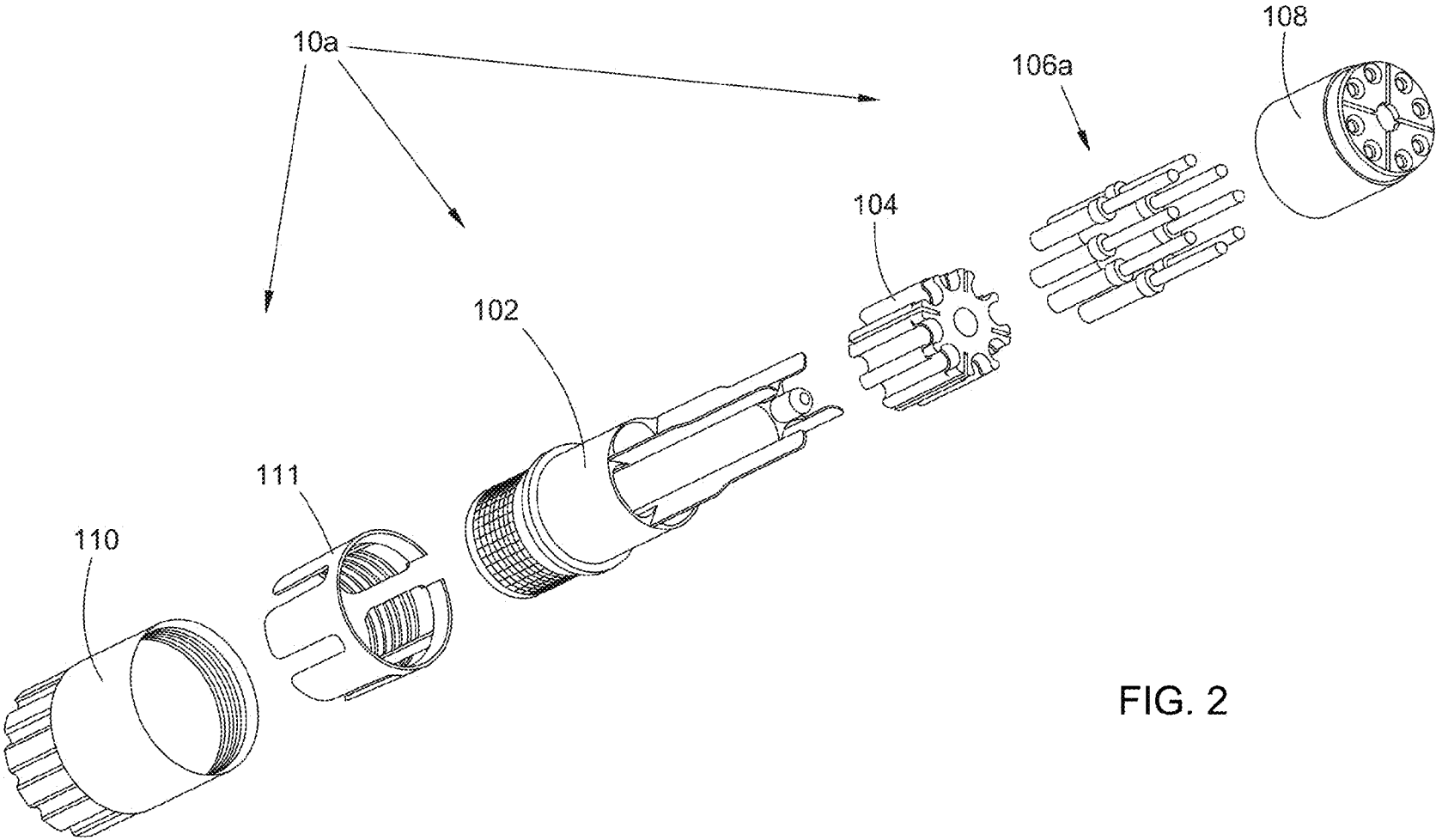
FIG. 2 is an exploded view of the plug-type connector of FIGS. 1A and 1B.
Figure 3A:
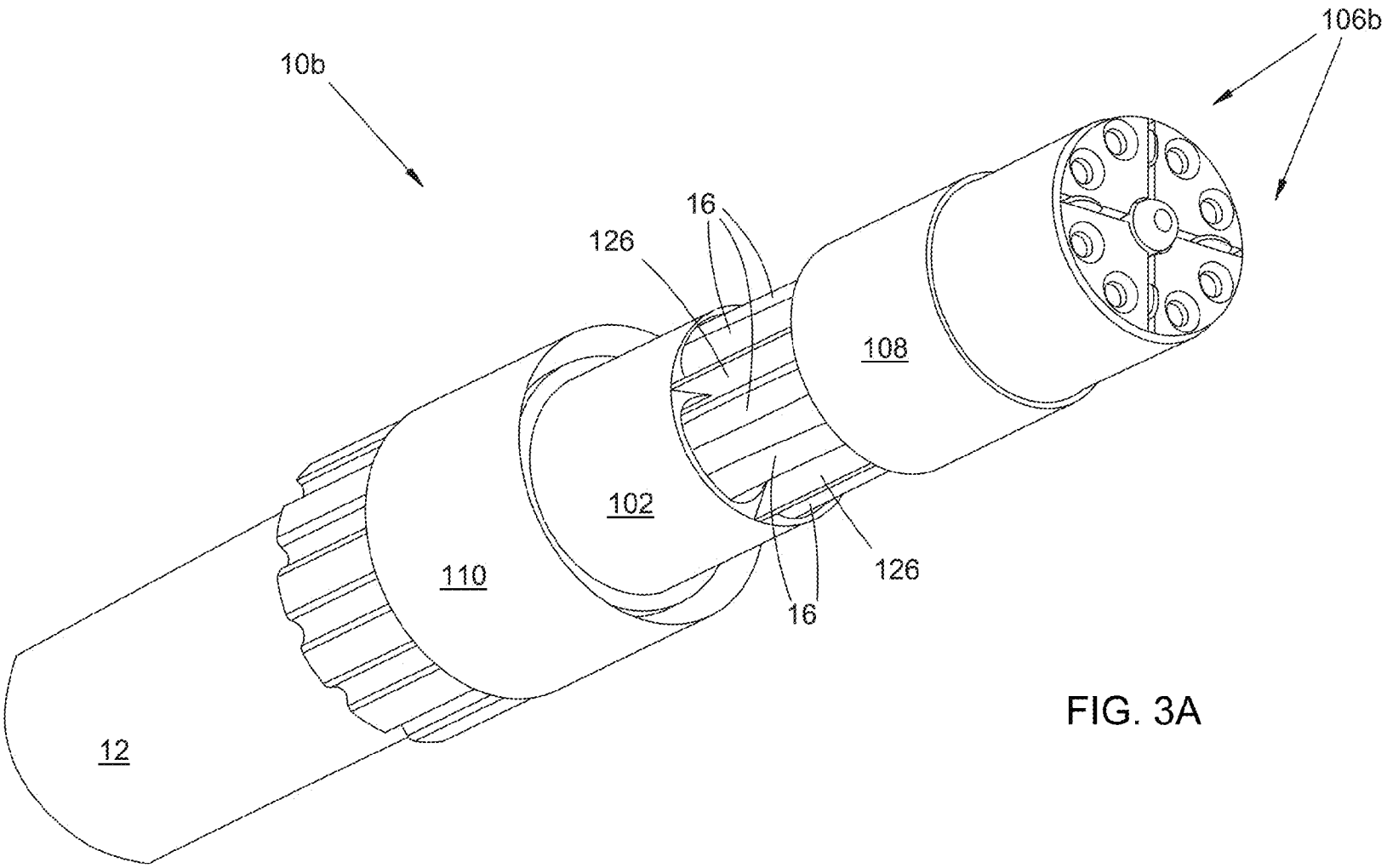
FIGS. 3A and 3B illustrate schematically an example receptacle-type connector for mating with the connector of FIGS. 1A and 1B. The outer ferrule and outer insulator are removed in FIG. 3B, and the inner ferrule is slightly rearward of its final position upon assembly.
Figure 3B:
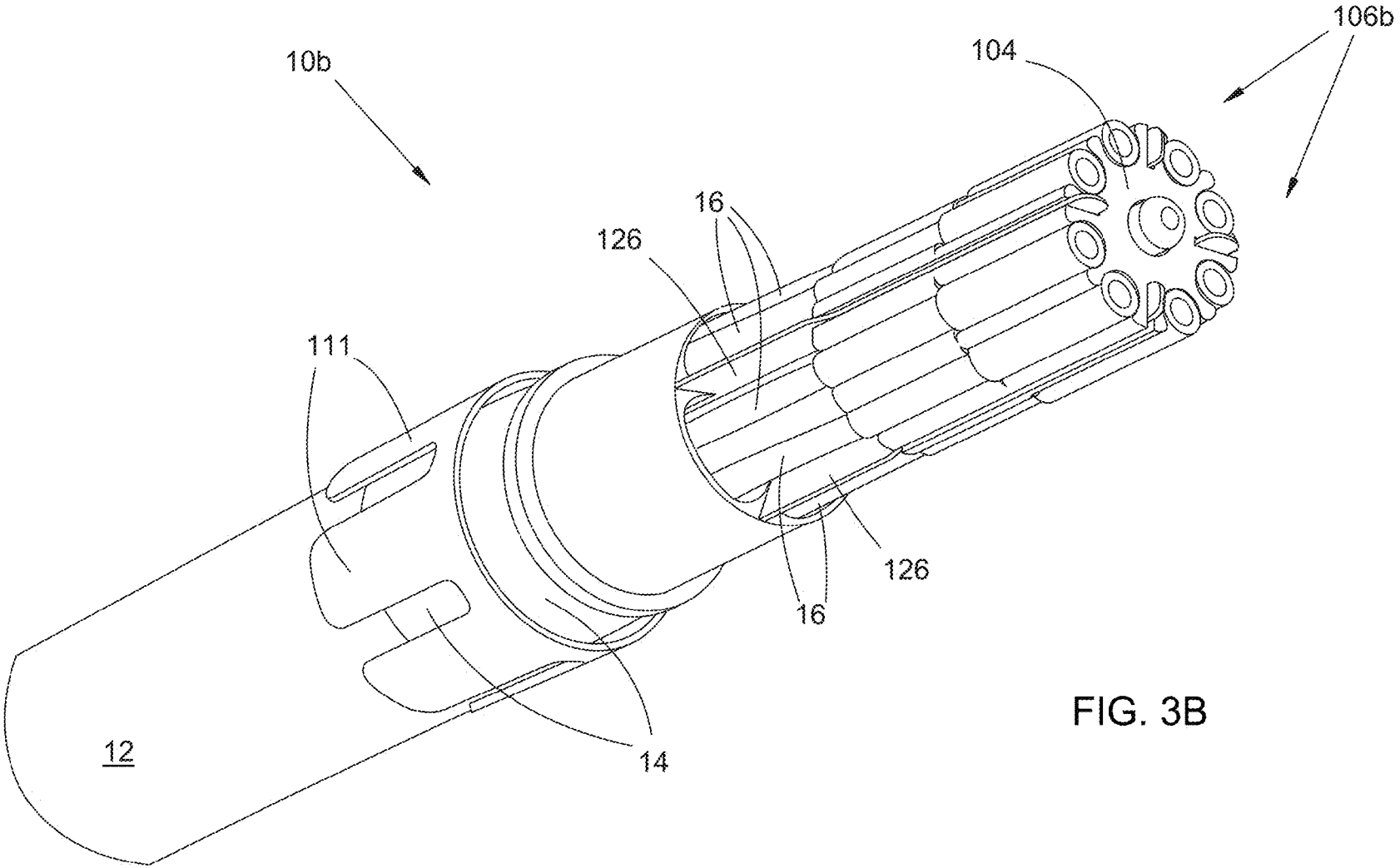
Figure 4:
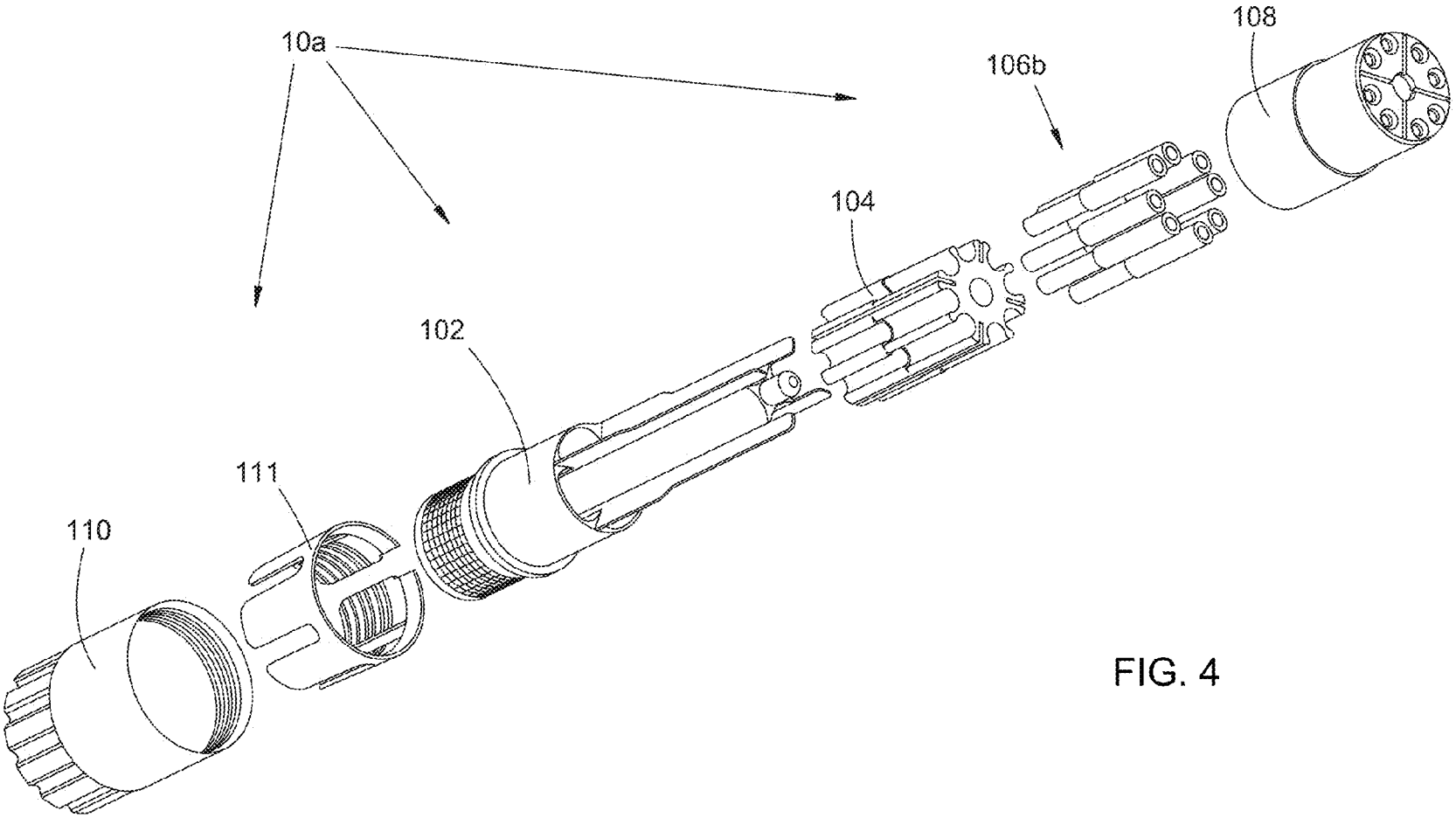
FIG. 4 is an exploded view of the receptacle-type connector of FIGS. 3A and 3B.
Figure 5A:
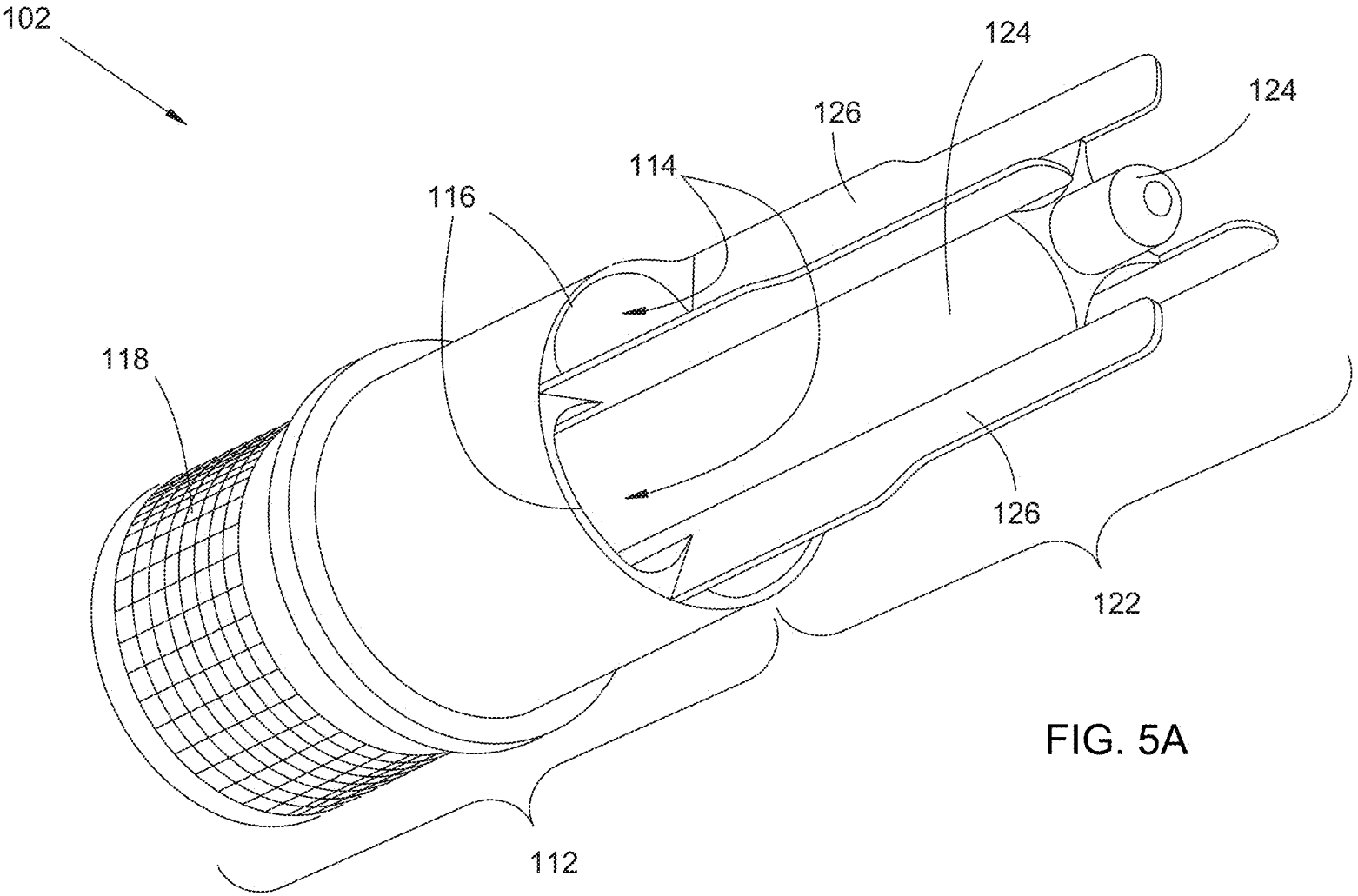
FIGS. 5A-5D are schematic perspective, side, back, and front views, respectively, of a conductive isolator body for the plug-type connector of FIGS. 1A, 1B, and 2. An isolator body for the receptacle-type connector of FIGS. 3A, 3B, and 4 is similar but can be longer.
Figure 5D:
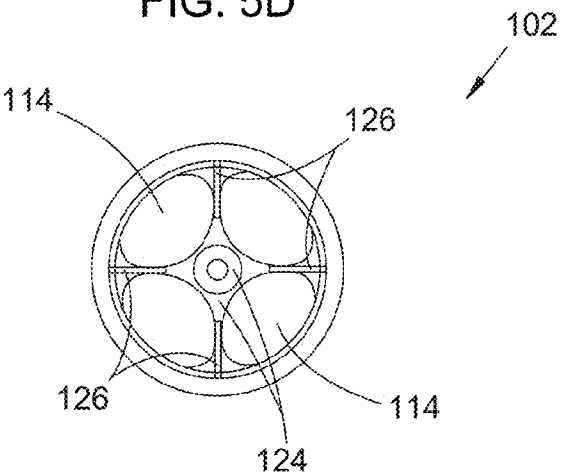
Figure 5C:
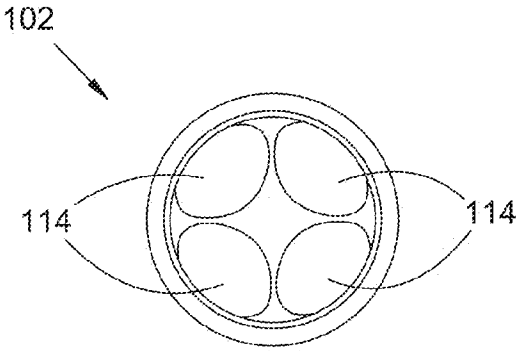
Figure 5B:
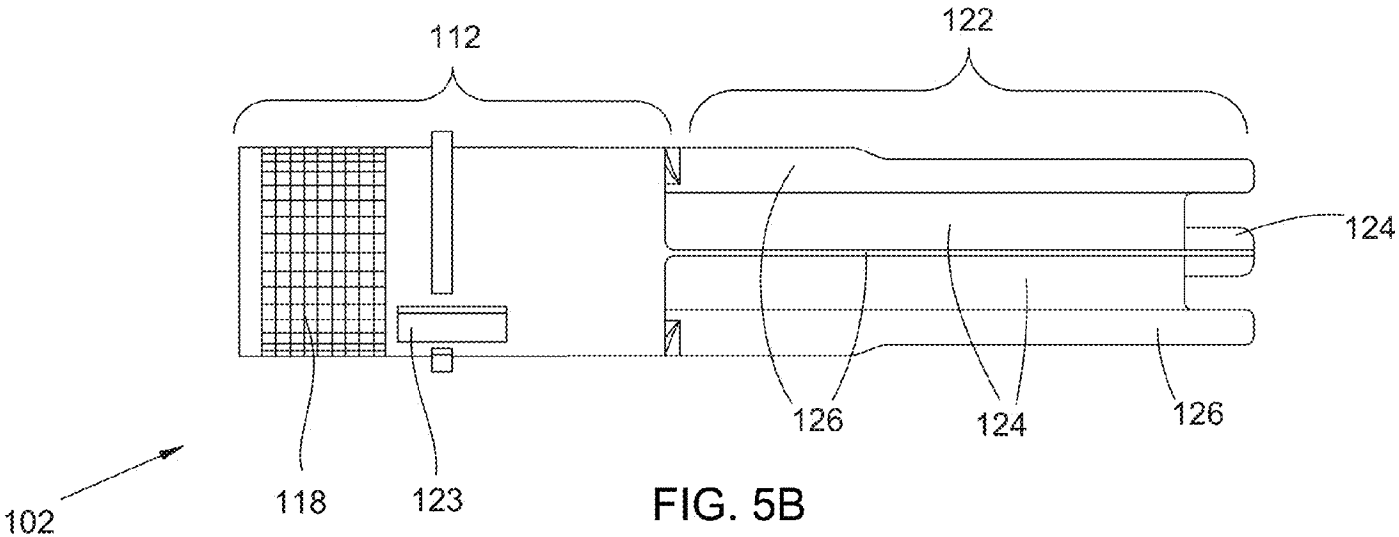

An example electrical connector 10*a* arranged as a plug-type connector is shown in FIGS. 1A, 1B, and 2. An analogous example electrical connector 10*b*, arranged as a receptacle-type connector to mate with the plug-type connector 10*a*, is shown in FIGS. 3 and 4. Throughout this disclosure, a reference number ending with an "a" refers specifically to a plug-type connector, while the same reference number ending with a "b" refers specifically to the analogous part in a mating receptacle-type connector. If such a reference number appears without the "a" or "b" elsewhere, it refers to both analogous parts generically. Reference numbers that never have an "a" or "b" refer to parts that do not differ or are substantially similar between the plug- and receptacle-type connectors 10*a*/10*b*. The connectors 10*a*/10*b* are arranged to terminate a so-called twisted-pair cable 12 having an even number 2N of longitudinally extending, individually insulated, electrically conductive wires 16 arranged as N twisted pairs (where N is an integer greater than one). In the examples shown, N=4, meaning that there are eight separate conductive wires in the cable 12 arranged as four twisted pairs. Connectors suitable for cables with other values of N>1 can be implemented within the overall scope of the present disclosure or appended claims. The twisted pairs are surrounded (circumferentially) by an electrically conductive shielding sheath 14 that is in turn surrounded (circumferentially) by an electrically insulating sheath. In some instances each twisted pair also has its own individual conductive shielding (e.g., metal braid or foil).

Designations "forward" and "rearward" and similar terms are defined relative to the cable 12 and the connector 10. "Rearward" means the direction back along the cable 12 away from the connector 10 that terminates the cable 12; "forward" means the opposite direction, i.e., along the cable 12 toward the connector 10 at the cable's terminal end. Note that when two connectors are mated, their respective "forward" and "rearward" directions are reversed relative to each other. "Longitudinal" and "axial" refer to directions parallel to "forward" and "rearward"; "transverse" and "radial" indicate directions substantially perpendicular to the cable and passing (at least approximately) through its longitudinal axis; "circumferential" indicates a directional path that would encircle the cable like a band.

Referring to FIGS. 1A through 4, each electrical connector 10 comprises (a) an electrically conductive isolator body 102, (b) an inner insulator 104, (c) 2N elongated, electrically conductive contacts 106, (d) an outer insulator 108, (e) an inner ferrule 111, and (f) an outer ferrule 110.

The electrically conductive isolator body 102 includes a forward segment 122 and a rearward segment 112 (FIGS. 5A-5D). The isolator body can comprise one or more metals or metal alloys, such as aluminum, stainless steel, beryllium copper, or other suitable metal(s) or alloy(s); any suitable metal(s) or alloy(s) can be employed. The isolator body 102 can be entirely metallic, can comprise a non-conductive material with a conductive, metallic coating or plating (e.g., polyetherimide (such as Ultem®), polyether ether ketone (PEEK), or other thermoplastic with electroless nickel or copper plating), or can comprise a non-conductive material impregnated with conductive, metallic material(s) sufficient to make it conductive. The isolator body can be fabricated in any suitable way, e.g., machining, molding, forging, die casting, and so forth. The rearward segment 112 includes N longitudinally extending channels 114 therethrough. Each channel 114 has an open forward end 116 and an open rearward end, for receiving therethrough an untwisted terminal segment of a corresponding one of the N pairs of wires 16 of the cable 12 (i.e., two of the wires 16 that originate from the same twisted pair). The forward segment 122 of the isolator body 102 includes a forward-extending central portion 124 and N ribs 126 extending radially from the central portion 124 and extending forward from the rearward segment 112 to a forward end of the connector 10. Each one of the ribs 126 separates adjacent forward openings 116 of the channels 114 so as to enable the untwisted terminal segments of the corresponding pair of wires 16 received through each channel 114 to extend forward between corresponding adjacent ribs 126.

To terminate the cable 12 with a connector, terminal segments of the wires 16 must be untwisted to enable each one of them to be stripped at its forward end and connected to a corresponding contact 106. If each pair has its own shielding, that also must be removed from the untwisted segments. Those untwisted terminal segments are vulnerable to outside signal interference as well as crosstalk between adjacent pairs of wires 16. The isolator body 102 is structurally arranged so as to reduce those undesirable effects, not only for the contacts 106 but also between the untwisted wires 16 behind the contacts. Isolation and shielding in that region within the connector behind the contacts is deficient or lacking in conventional connectors. The electrically conductive isolator body 102 is grounded by contact with the shielding sheath 14 of the cable 12 (described further below; shown in FIGS. 2 and 4). Within the channels 114 through the rearward segment 112 of the isolator body 102, each pair of wires 16 is surrounded (circumferentially) by the conductive material of the isolator body 102, thereby shielding each pair from outside interfering signals and also isolating each pair from the others. The channels 114 do not extend the all the way to the contacts 106 to enable easy assembly of the connector 10 and also to enable later disassembly, repair, and reassembly of the connector 10 (i.e., to provide reparability or re-workability).

The central portion 124 and the ribs 126 of the forward segment 122 extend forward from the rearward segment 112 to the front end of the connector 10. Over that length, they continue to separate adjacent pairs of the wires 16 and provide some degree of shielding and isolation of each pair of wires from the others. However, the forward segment 122 alone does not provide complete shielding or isolation of the pairs from one another, and provides little or no shielding from outside interfering signals. As described below, in the assembled connector 10, a conductive portion of a connector insert or connector housing in some embodiments, or an outer conductive shield in other embodiments, substantially encloses the wires 16 along the forward segment 122, and the ribs 124 extend radially nearly to those enclosing structures.

Figure 6A:
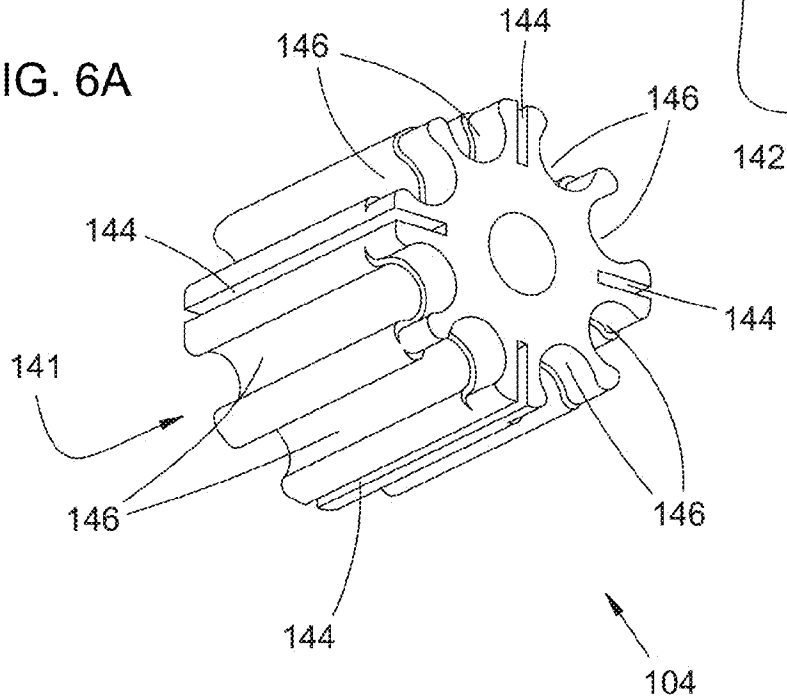
FIGS. 6A-6C are schematic perspective, front, and back views, respectively, of an inner insulator for the plug-type connector of FIGS. 1A, 1B, and 2. An inner insulator for the receptacle-type connector of FIGS. 3A, 3B, and 4 is similar but can be longer.
Figure 6B:
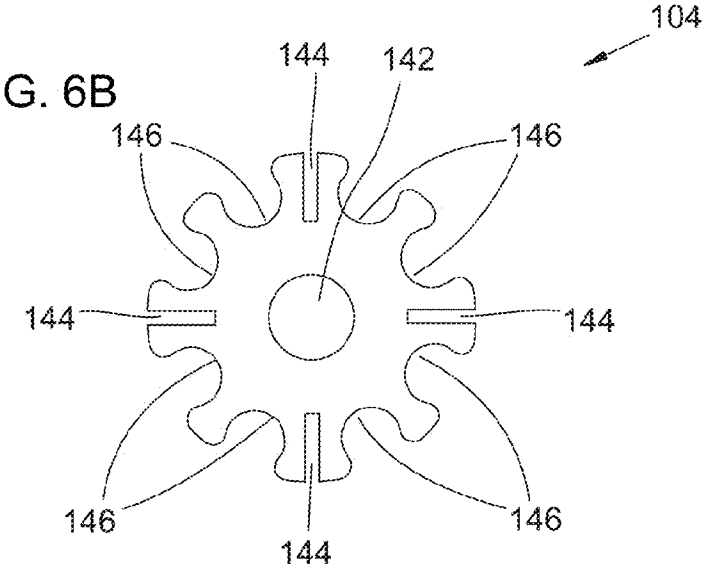
Figure 6C:
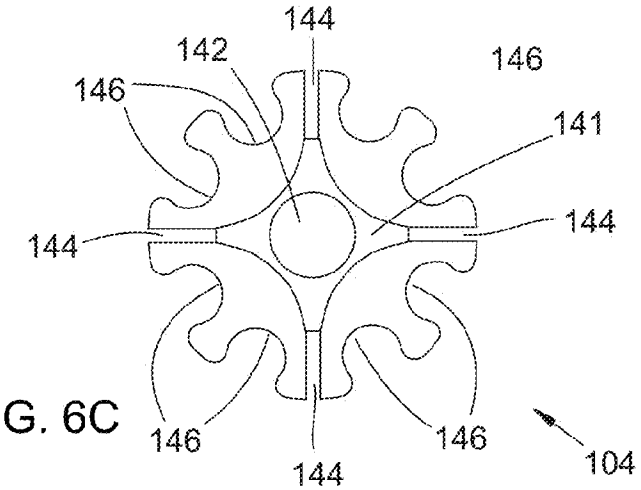
Figure 8:
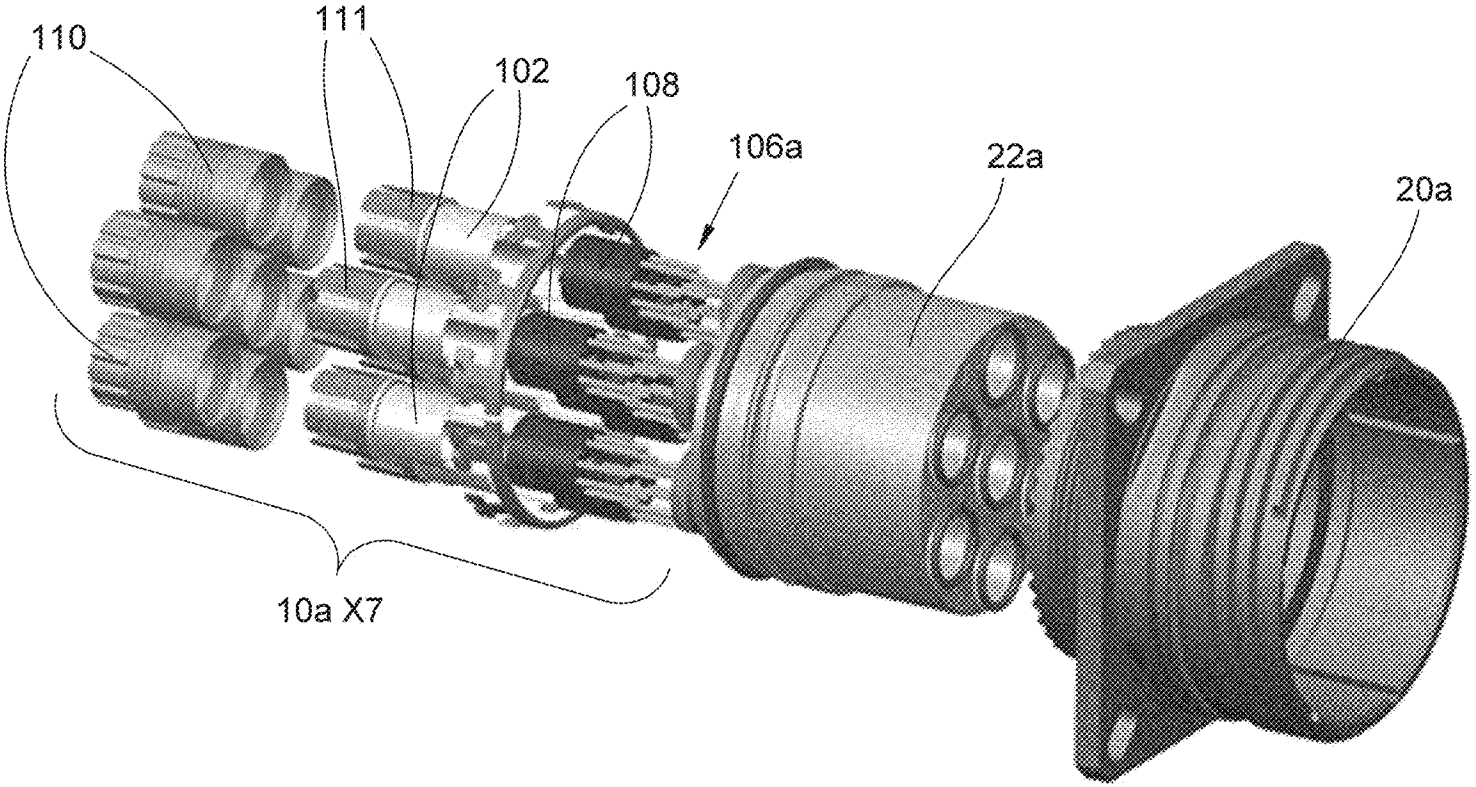
FIGS. 8 and 9 are schematic exploded and perspective views, respectively, of an example 7-plug connector assembly incorporating seven of the plug-type connectors of FIGS. 1A, 1B, and 2.
Figure 9:
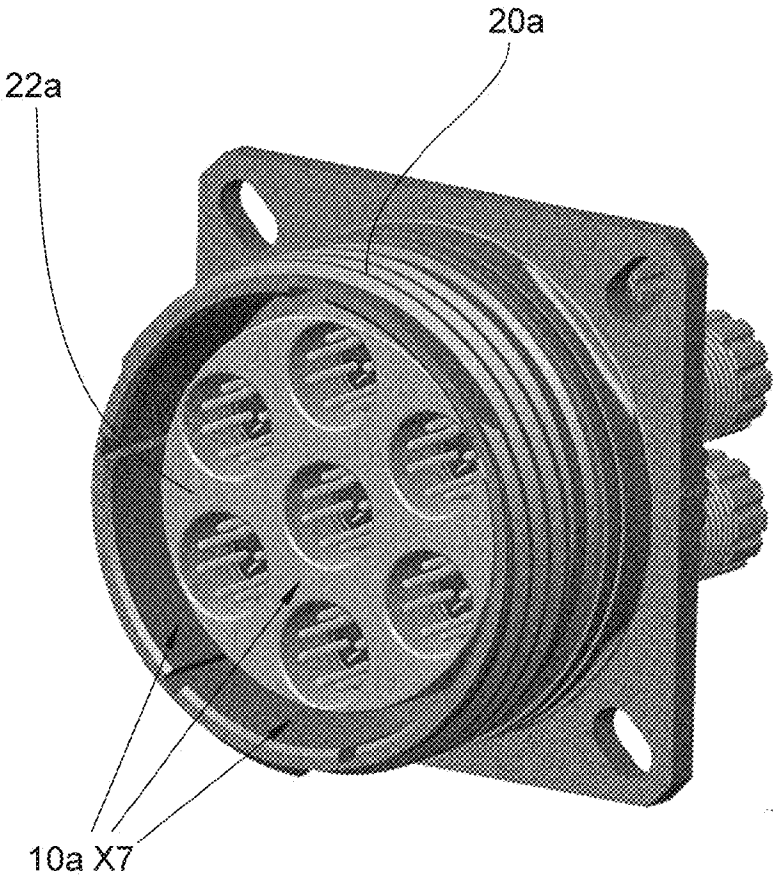
Figure 11:
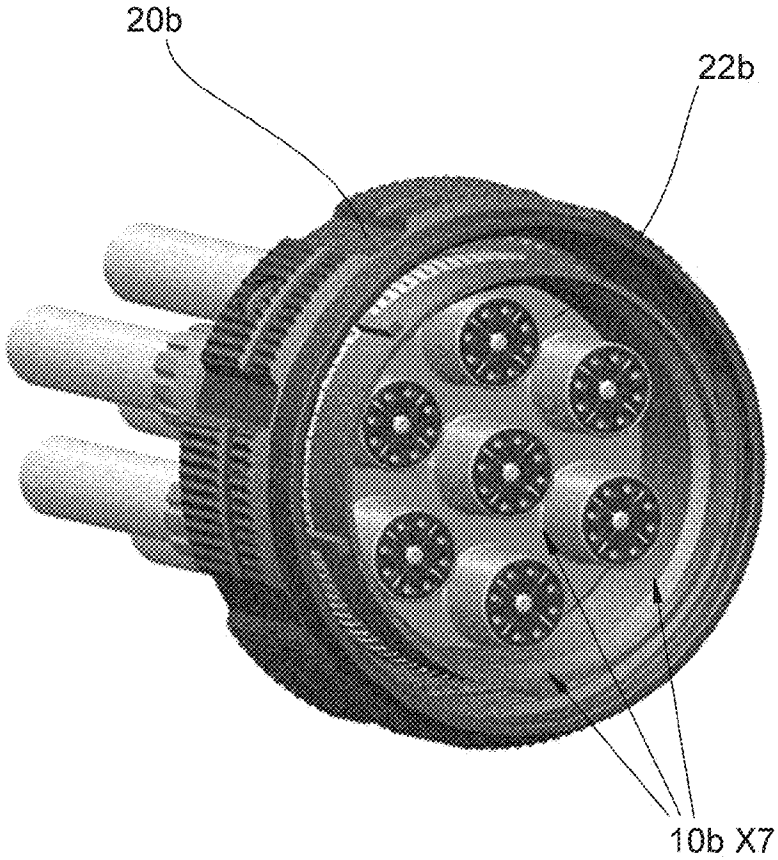
FIGS. 10 and 11 are schematic exploded and perspective views, respectively, of an example 7-receptacle connector assembly, for mating with the connector assembly of FIGS. 8 and 9, that incorporates seven of the receptacle-type connectors of FIGS. 3A, 3B, and 4.
Figure 10:
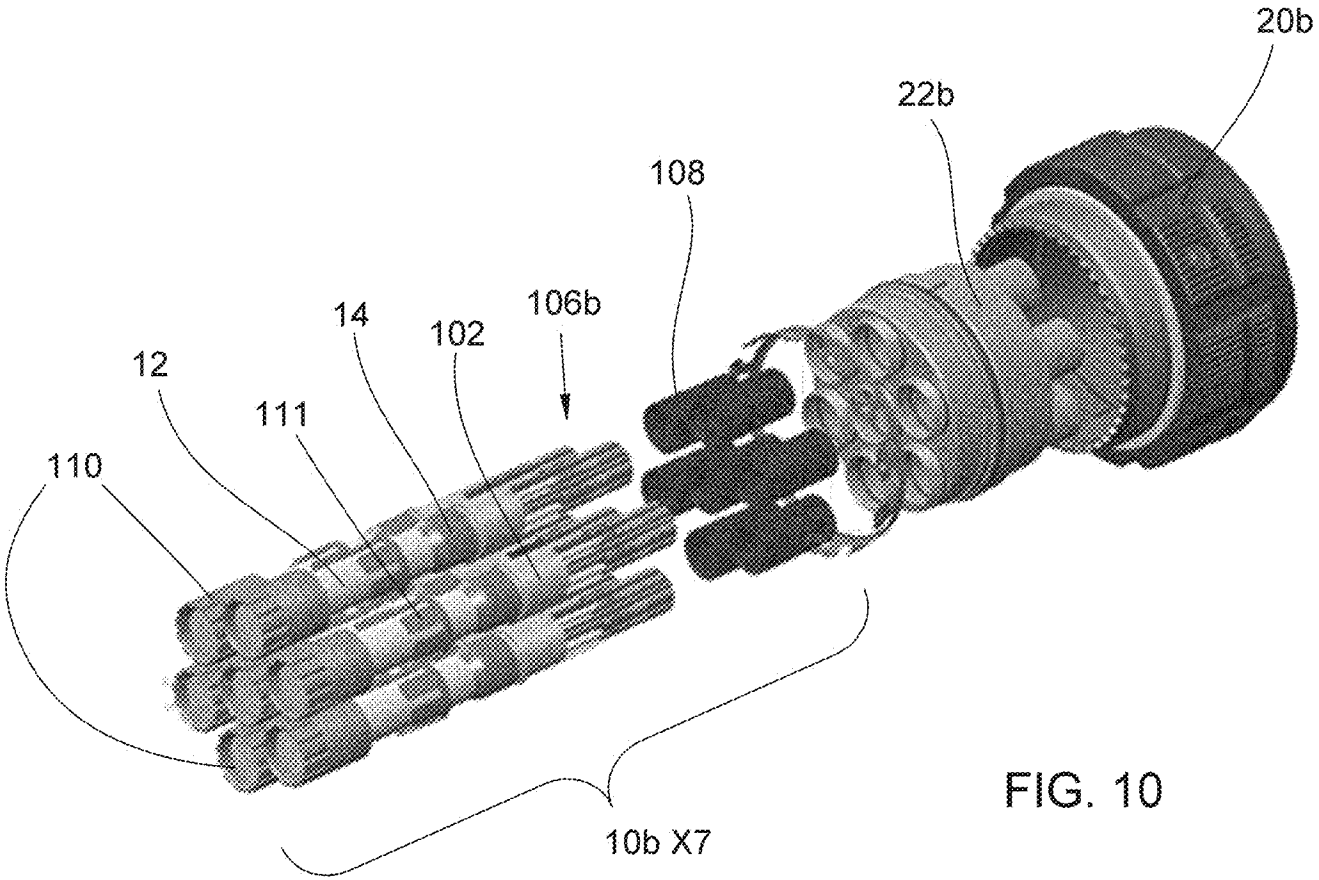

The inner insulator 104 and the outer insulator 108 each comprise one or more electrically insulating materials. They can comprise the same material(s) or different materials. Examples of suitable materials can include, e.g., polyetherimide (Ultem®), polyether ether ketone (PEEK), or polytetrafluoroethylene (PTFE or Teflon®; any suitable insulating material(s) can be employed. The inner insulator 104 (FIGS. 6A-6C) forms a rearward-facing open cavity 141 arranged to receive therein at least a forward portion of the forward segment 122 of the isolator body 102; the lateral inner surfaces of the cavity 141 substantially conform to the forward segment of the isolator body 102, leaving no substantial voids between those surfaces. A hole 142 through a forward end wall of the cavity 141 is arranged to receive therethrough a forward end of the central portion 124 of the isolator body 102. The inner insulator 104 further includes N slots 144 extending radially from the cavity 141 to an outer surface of the inner insulator 104. Each slot 144 is arranged to receive therethrough a corresponding one of the ribs 126 of the isolator body 102. Between each adjacent pair of slots 144 on an outer surface of the inner insulator are a pair of longitudinally extending grooves 146 (a total of eight grooves in the example embodiment). Each groove 146 extends the length of the inner insulator 104 and has open forward and rearward ends.

The electrical connector 10 includes 2N elongated, electrically conductive contacts 106 (i.e., one for each wire 16 of the cable 12). Each of the contacts 106 comprises one or more metals or metal alloys, such as copper, leaded nickel copper, beryllium copper, CuCrZr alloys, or gold- or silver-plated aluminum; any suitable metal(s) or alloy(s) can be employed. Each one of the contacts 106 is received in a corresponding one of the grooves 146 of the inner insulator 104. That arrangement of the inner insulator 104 electrically isolates each one of the contacts 106 from the isolator body 102 and the other contacts 106. Each contact 106 has an open rearward end that is positioned at the open rearward end of the corresponding groove 146, where it receives and secures (typically by crimping) a stripped forward end of a corresponding one of the 2N wires 16 that has passed through the corresponding channel 114. The stripped forward end of each wire 16 can be secured in the rearward open end of the corresponding contact 106 in any suitable way, e.g., by soldering or ultrasonic welding.

Figure 7A:
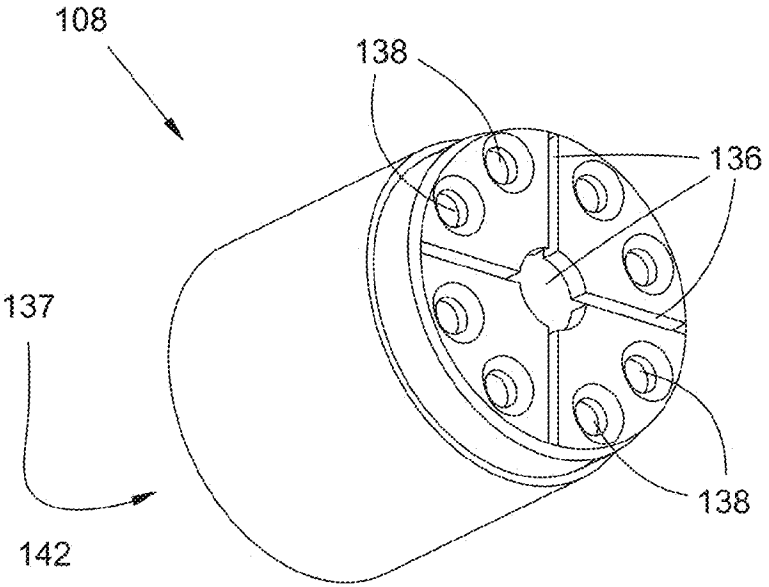
FIGS. 7A-7C are schematic perspective, front, and back views, respectively, of an outer insulator for the plug-type connector of FIGS. 1A, 1B, and 2. An outer insulator for the receptacle-type connector of FIGS. 3A, 3B, and 4 is similar but can be longer.
Figure 7B:
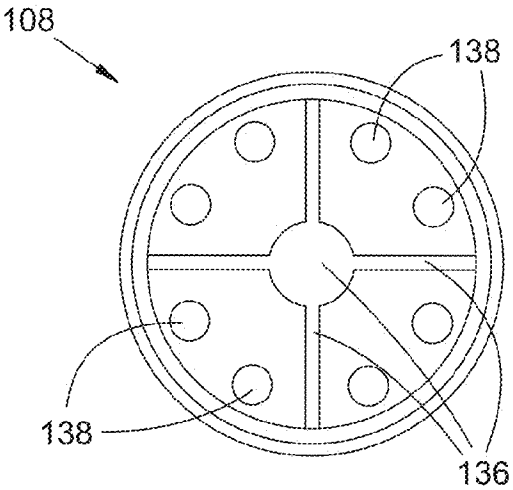
Figure 7C:
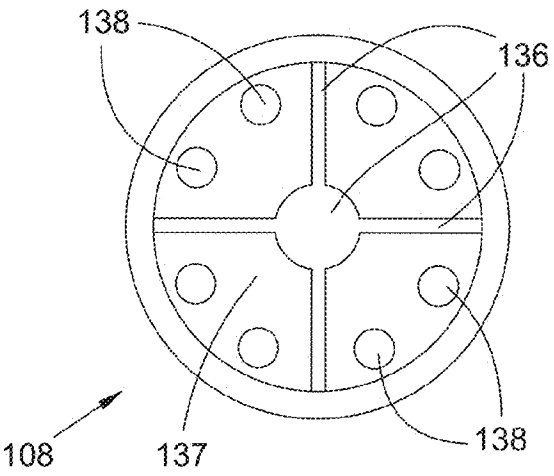

The outer insulator 108 (FIGS. 7A-7C) forms a rearward-facing open cavity 137 that is arranged to receive therein at least a portion of the inner insulator 104, at least a portion of each one of the contacts 106, and at least the forward portion of the forward segment 122 of the isolator body 102 (i.e., that portion of the forward segment 122 that is received within the inner insulator 104). Lateral walls of the cavity circumferentially surround those portions received within the cavity 137, and serve to electrically isolate each one of the contacts 106 from a conductive outer shell of the connector or a conductive connector insert of a connector assembly (see below). An opening 136 through the forward end wall of the cavity 137 is suitably shaped and positioned to receive therethrough the forward end of the central portion 124 of the isolator body 102 and forward ends of the ribs 126. Those forwardly protruding portions of the isolator body 102 come into contact with their counterparts when the electrical connector 10 is engaged with a mating connector, thereby establishing a continuous electrical ground across the mated connectors. Also through the front end wall of the cavity 137 are 2N holes 138 arranged to align with the open forward ends of the grooves 146 of the inner insulator 104.

In FIGS. 1A, 1B, and 2, the connector 10 is arranged as a plug-type connector 10*a* wherein each one of the contacts 106 comprises an elongated pin contact 106*a*. Each pin contact 106*a* is structurally arranged to protrude through the corresponding hole 138 in the outer insulator 108 and protrude forward from the outer insulator 108. In FIGS. 3A, 3B, and 4, the connector 10 is arranged as a receptacle-type connector 10*b* wherein each one of the contacts 106 comprises an elongated socket contact 106*b*. Each socket contact 106*b* has an open forward end positioned at the corresponding hole 138 in the outer insulator 108 to receive a corresponding pin of a mating plug-type connector. The socket contacts 106*b* typically do not protrude from the holes 138, and pins from a mating connector pass through the corresponding holes 138 to be received in the corresponding socket contact 106*b*.

In some examples, the isolator body 102, the inner insulator 104, and the outer insulator 108 can be substantially identical in a plug-type connector 10*a* or a receptacle-type connector 10*b*. Simplification of manufacturing processes and parts inventory can make that an attractive scenario. In other examples, it can be advantageous (e.g., for overall length reduction of the mated connectors) for those parts to differ in their specific dimensions or proportions between the plug-type connector 10*a* and the receptacle-type connector 10*b*. For example, because a significant portion of the pin contacts 106*a* protrude out of the inner and outer insulators 104/108 and only a portion resides in the groove 146, those insulators can typically be shorter in their longitudinal dimensions than their counterparts in a receptacle-type connector 10*b*. In the receptacle-type connector 10*b*, the entire length of the socket contact 106*b* is contained within the groove 146, often requiring that the insulators 104/108 be somewhat longer. For similar reasons, the forward segment 122 of the isolator 102 is often longer in a receptacle-type connector 10*b* than in a plug-type connector 10*a*.

In addition to electrically isolating the contacts 106, the outer insulator 108 can also serve to retain the contacts 106 within their corresponding grooves 146; other suitable means can be employed. In some examples, each one of the contacts 106 is retained in the corresponding groove 146 of the inner insulator 104 by a snap fit, press fit, or interference fit. That arrangement may be particularly suitable when the inner insulator comprises a material that is somewhat resilient or deformable, e.g., a polymer or resin. One or both of the groove 146 or the contacts 106 can be arranged with mating flanges, steps, or ridges so as to more robustly retain the contacts 106 in the grooves 146. It can be especially advantageous to limit or prevent longitudinal movement of the contacts 106 within the grooves 146 in response to forces applied when the connectors 10 are repeatedly engaged with and disengaged from mating connectors.

Figure 12:
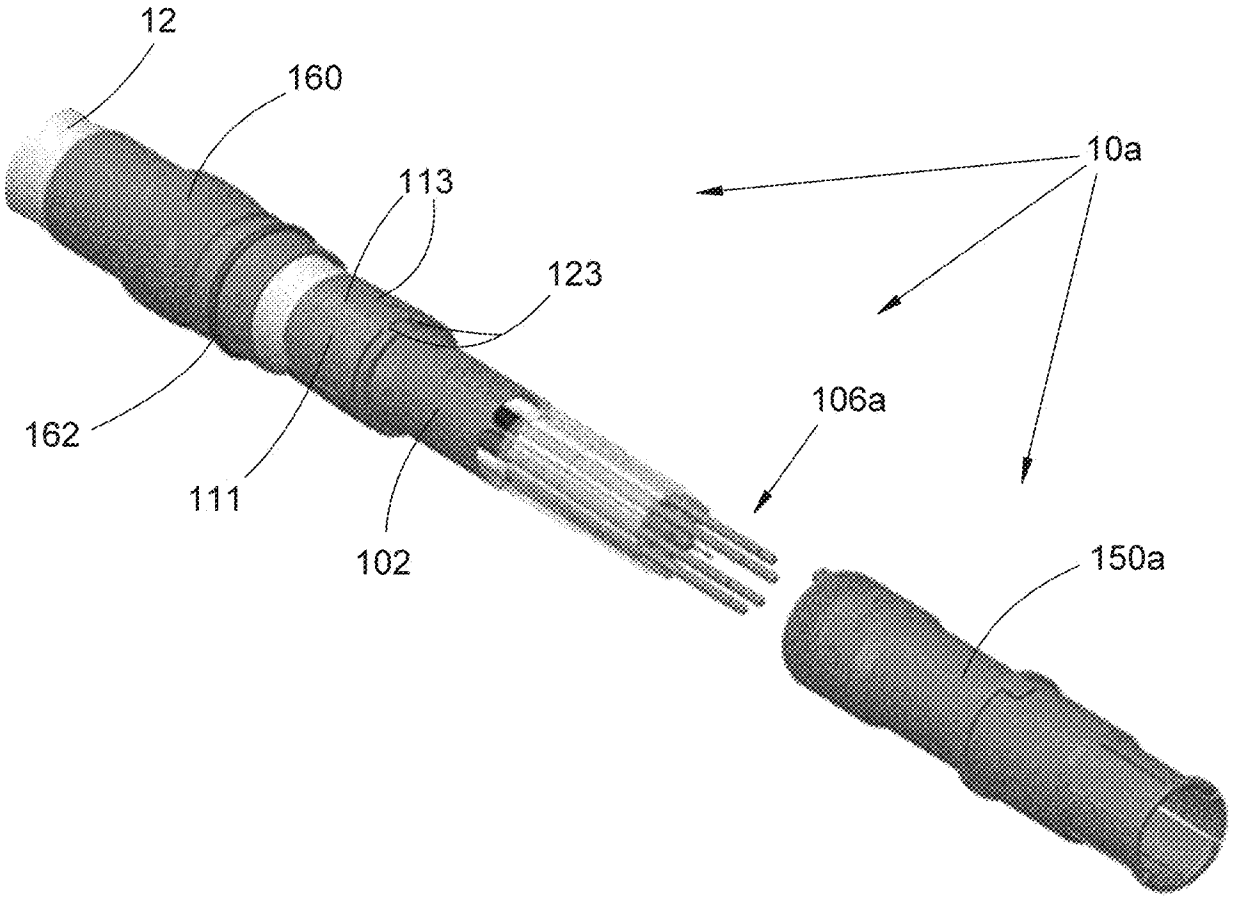
FIGS. 12 and 13 are schematic exploded and perspective views of another example plug-type connector for a cable comprising four twisted pairs.
Figure 13:
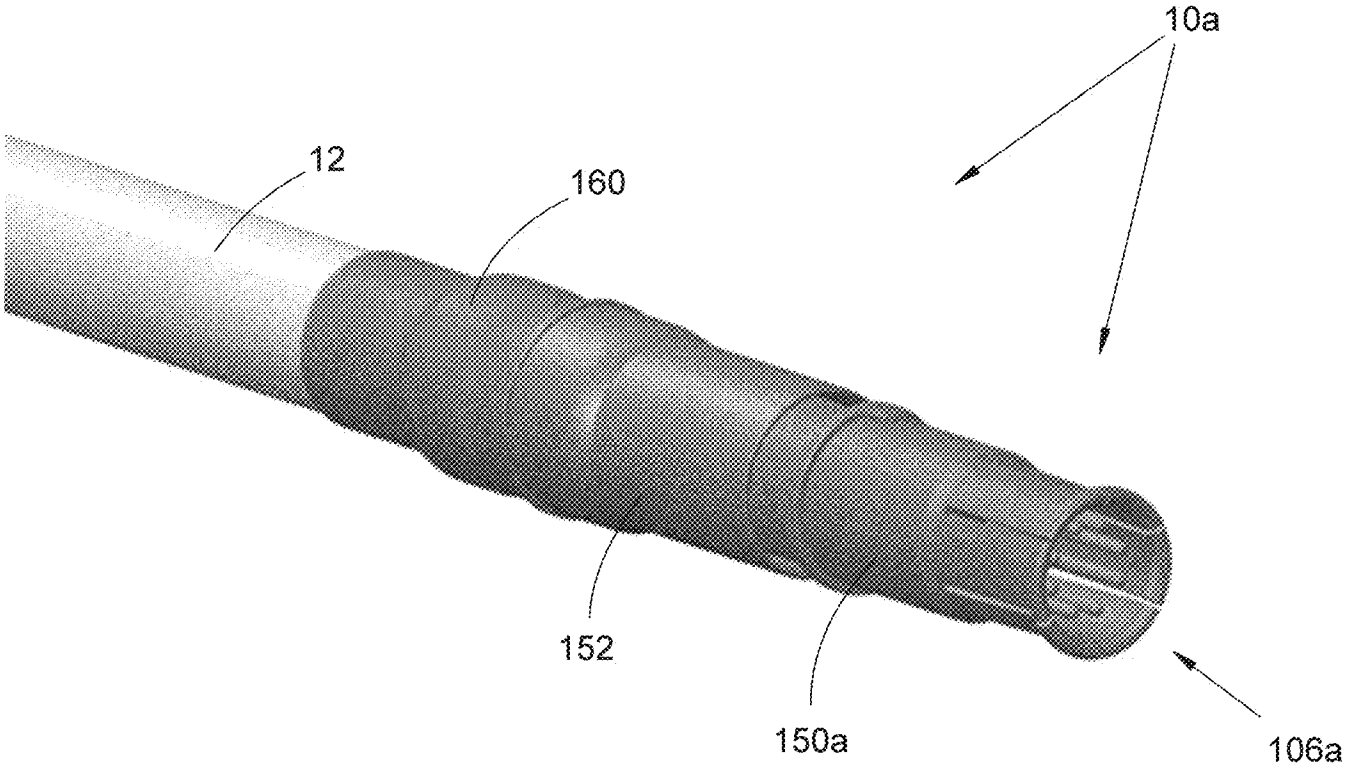
Figure 14:
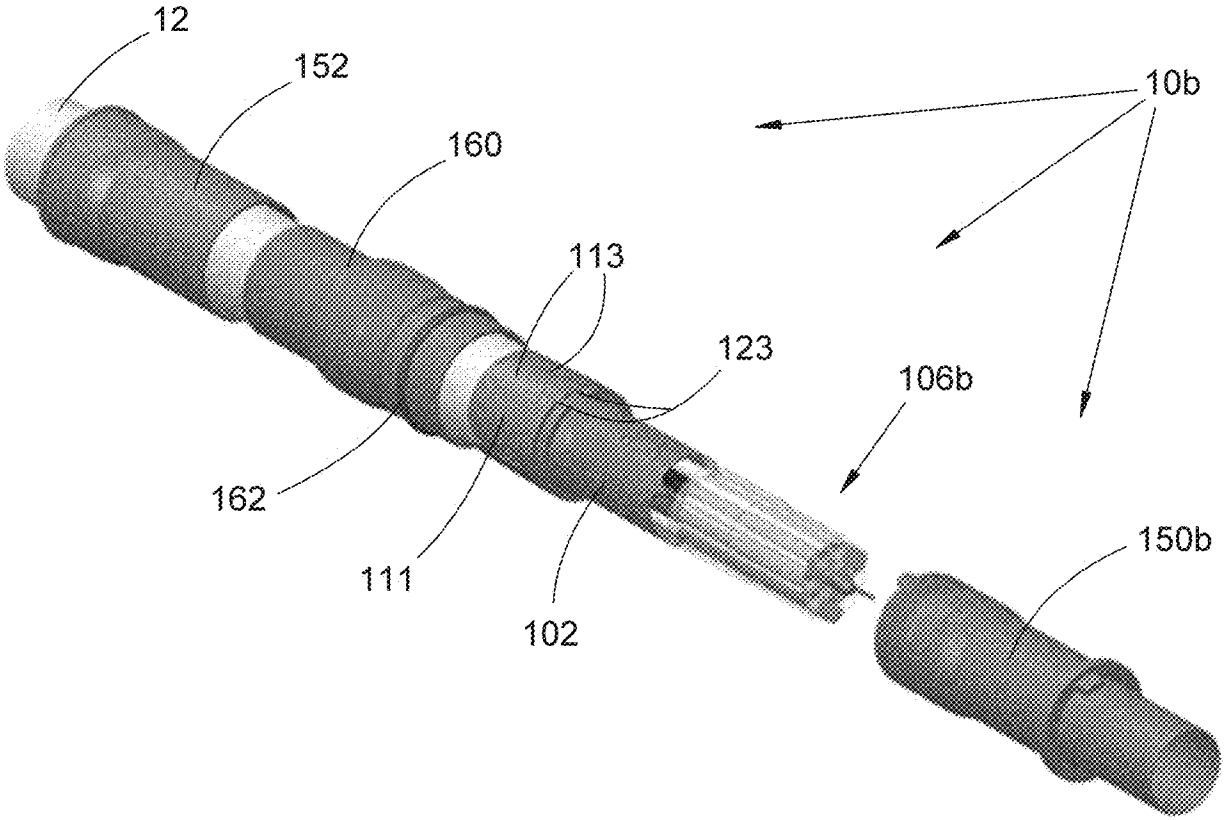
FIGS. 14 and 15 are schematic exploded and perspective views of another example receptacle-type connector. The connector of FIGS. 14 and 15 mates with the connector of FIGS. 12 and 13.
Figure 15:
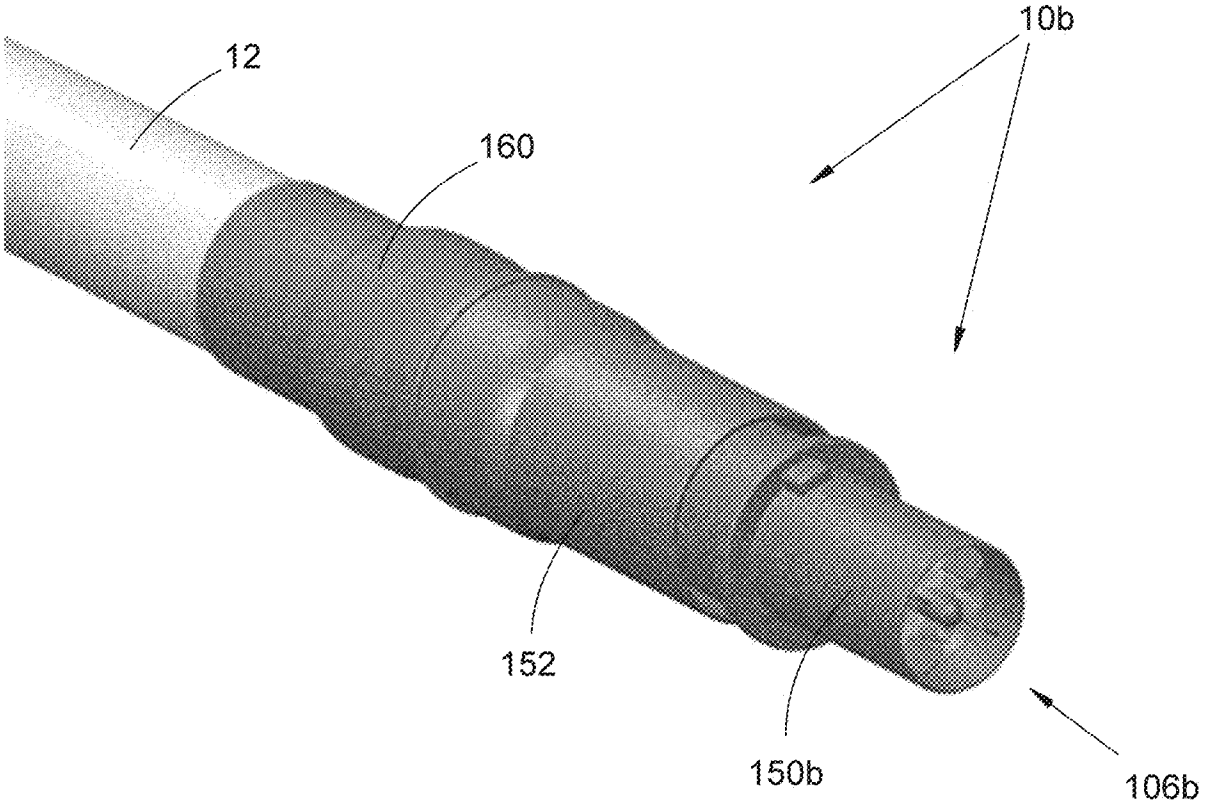

The inner ferrule 111 is structurally arranged to at least partly circumferentially encompass at least a rearward portion of the rearward segment 112 of the isolator body 102. A forward end of the shielding sheath 14 of the cable 12 is positioned between the inner ferrule 111 and the isolator body 102 and is in electrical contact with the isolator body 102. The shielding sheath 14 of the cable 12 typically comprises a metal foil or metal braid. The inner ferrule 111 typically comprises one or more materials that are at least minimally deformable. In some examples the inner ferrule 111 is sized to provide a press fit or interference fit around the isolator body 102, with the deformability of the inner ferrule enabling it to be moved into position on the isolator body 102. In the example in the drawings, the inner ferrule 111 does not fully encircle the isolator body, which provides additional deformability. The inner ferrule can be made with a slight rearward taper, if desired, to facilitate placement on the isolator body 102. In some examples one or both of the inner ferrule 111 and the rearward segment 112 of the isolator body 102 are structurally adapted to limit or prevent rotation about a longitudinal axis of the inner ferrule 111 around the isolator body 102. Such rotation could damage the segment of the shielding sheath 14 between the inner ferrule 104 and the isolator body 102. In the example shown in FIG. 5B, a tab 123 on the isolator body 102 is arranged to engage the gap in the inner ferrule 111 to limit or prevent rotation. In the examples of FIGS. 12 and 14, the gap 113 on the inner ferrule 111 engages tabs 123 on the isolator body 102. Other suitable arrangements can be employed for limiting or preventing rotation of the inner ferrule 111 about the isolator body 102.

The outer ferrule 110 is structurally arranged to retain the inner ferrule 111 on the rearward segment 112 of the isolator body 102. The outer ferrule 110 urges the inner ferrule 111 inward toward the rearward segment 112 of the isolator body 102, thereby retaining the shielding sheath 14 on the rearward segment 112 of the isolator body 102. The urging inward of the inner ferrule 111 by the outer ferrule 110 can act instead of or in addition to any retaining force generated by whatever deformation of the inner ferrule 111 might be required to position it on the isolator body 102. In some examples the outer ferrule 110 can deform the inner ferrule 111 inward toward the isolator body 102. In any of these arrangements, the goal is to establish and maintain reliable electrical contact between the isolator body 102 and the shielding sheath 14 of the cable 12, so that all of those components can be held at electrical ground.

The inner ferrule 111 and the outer ferrule 110 can comprise any one or more materials having suitable mechanical properties to reliably hold the connector together (discussed further below) and to maintain electrical contact between the cable shielding sheath 14 and the isolator body 102. It can be advantageous if the ferrules 110/111 are also electrically conductive. In that case, the ferrules 110/111 can comprise one or more metals or metal alloys, or one or more non-conductive materials coated, plated, or impregnated with metallic material(s). The two ferrules 110/111 can comprise the same material(s) or different materials; often they comprise different materials. Examples of suitable materials can include beryllium copper, aluminum, stainless steel, or polyetherimide or polyether ether ketone (PEEK) with electroless nickel or copper plating; any suitable material(s) can be employed.

In some examples, the rearward segment 112 of the isolator body 102 has an outer surface with a knurled rearward portion 118. The knurled surface enhances retention of the cable shielding sheath 14 between the knurled surface of the isolator body 102 and the inner ferrule 111. In some examples the outer ferrule 110 can be structurally arranged to engage and retain a forward end of the insulating sheath of the cable 12. Such engagement and retention can serve, for example, to seal the cable against moisture or environmental contaminants. Instead or in addition, the connector 10 can further comprise a length of shrink tubing 160 or one or more O-rings 162 structurally arranged so as to substantially seal a forward end of the insulating sheath of the cable 12 or a rearward end of the outer ferrule 110.

In some examples, the outer ferrule 110 can be structurally arranged to engage (mechanically, and also possibly electrically) a connector insert 22 or a connector housing 20 of a connector assembly (e.g., FIGS. 8-11). One or more electrical connectors 10 can be mounted together in a single connector assembly to enable simultaneous connection of multiple pairs of cables. In the examples of FIGS. 8-11, seven connectors 10 are incorporated into a single connector assembly with six of the connectors 10 arranged in a substantially regular hexagonal arrangement and with one of the connectors 10 at about the center of the hexagonal arrangement. The multiple electrical connectors 10 are each inserted into corresponding holes in an electrical conductive connector insert 22. The connector insert 22 holds the electrical connectors 10 in a substantially parallel, spaced apart, substantially flush arrangement (i.e., the multiple connectors 10 in the connector assembly are at about the same longitudinal position relative to one another). Each corresponding outer ferrule 110 can engage the connector insert 22 to hold the corresponding electrical connector 10 in place. In such an arrangement, the electrically conductive connector insert 22 is grounded, e.g., by direct contact with the isolator insert 102 or with an electrically conductive outer ferrule 110. Mechanical engagement between the outer ferrule 110 and the connector insert 22 can be achieved in any suitable way; mating threads can be particularly suitable. Once the connector 10 is inserted into the electrically conductive and grounded connector insert 22, the insert 22 serves as electrical shielding that circumferentially surrounds the forward segment 122 of the isolator body 102 (i.e., that portion from which peripheral electrical shielding was missing). The only remaining gap in the electrical shielding is the thickness of the outer insulator 108 that is between the outer edge of each rib 126 and the inner surface of the holes through the connector insert 22. Engagement of the outer ferrule 110 with a connector insert 22 or a connector housing 20 can serve to retain the inner ferrule 111 on the rearward segment 112 of the isolator body 102.

Figure 17:
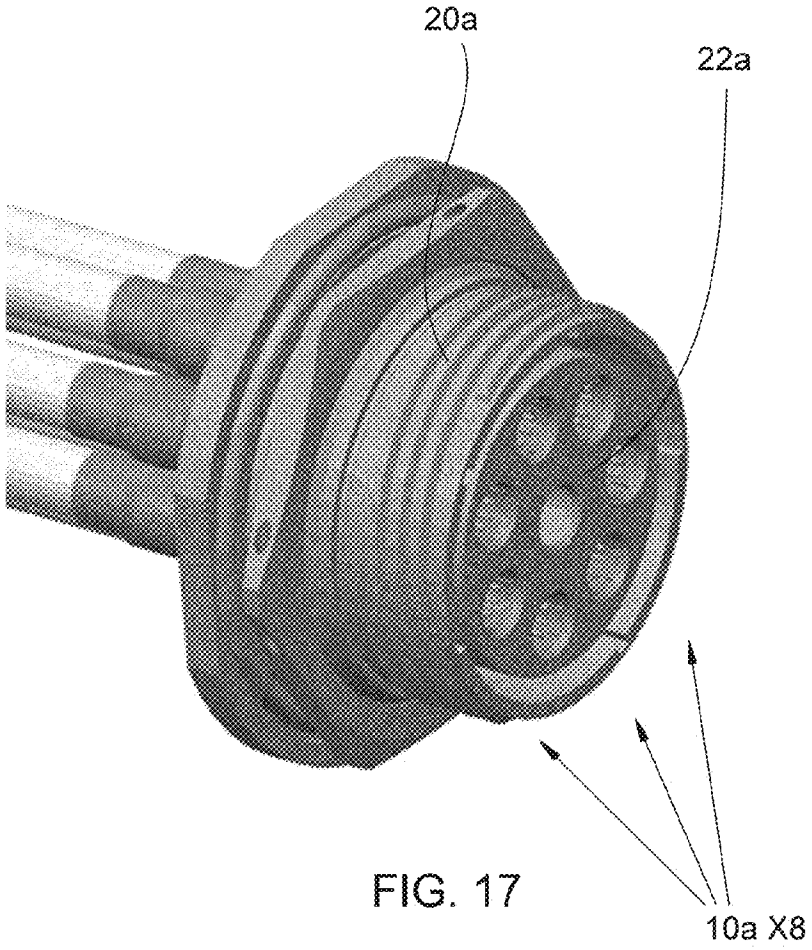
FIG. 17 is a schematic perspective view of an example 8-plug connector assembly, for mating with the connector assembly of FIG. 16, that incorporates eight of the plug-type connectors of FIGS. 12 and 13.
Figure 16:
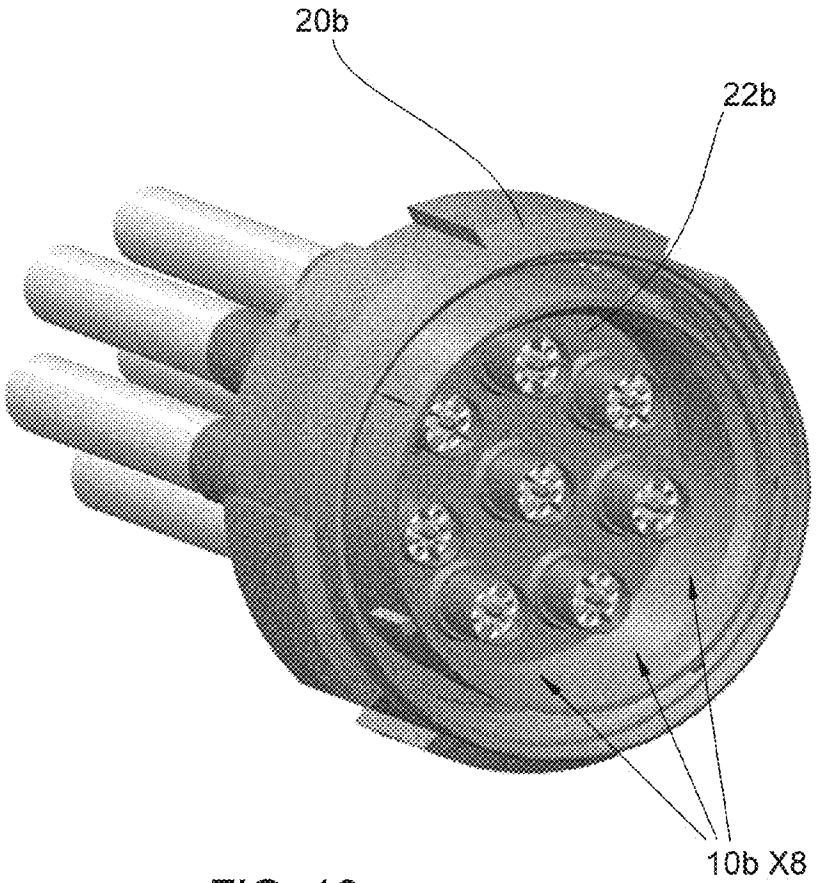
FIG. 16 is a schematic perspective view of an example 8-receptacle connector assembly incorporating eight of the receptacle-type connectors of FIGS. 14 and 15.
Figure 18:
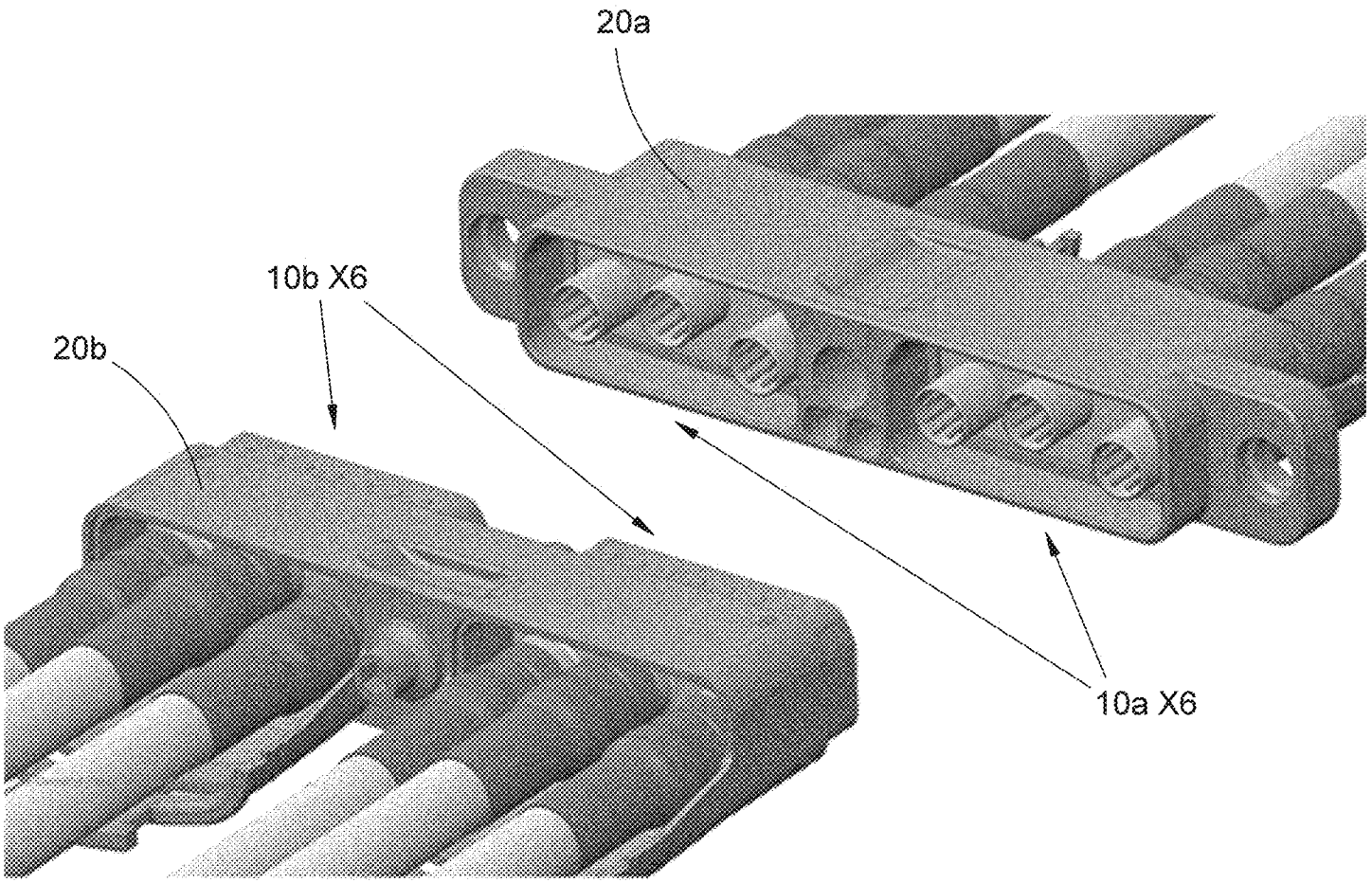
FIG. 18 illustrates schematically example mating 6-plug and 6-receptacle connector assemblies incorporating plug- and receptacle-type connectors of FIGS. 12-15.
Figures 19, 20:
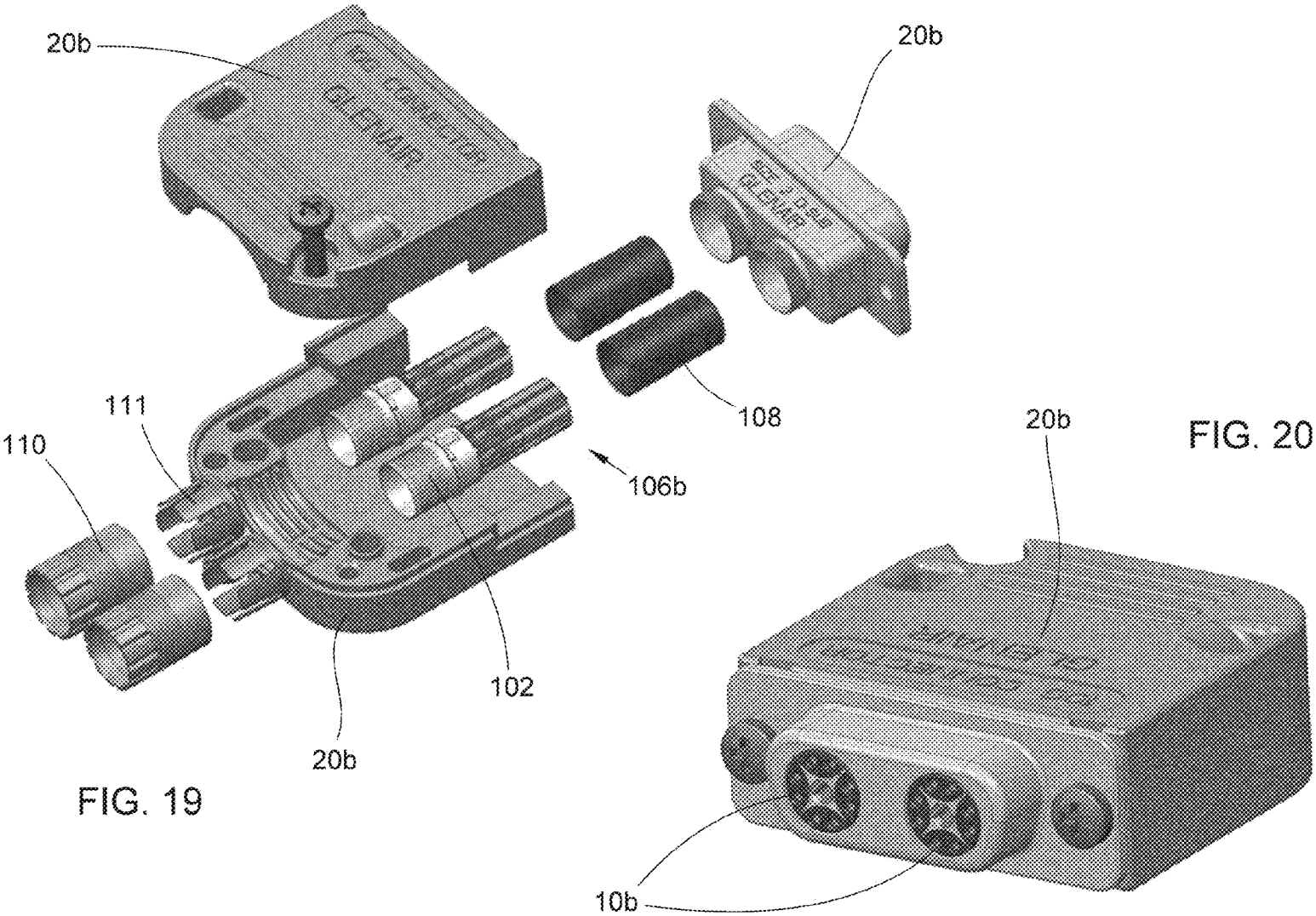
FIGS. 19 and 20 are schematic exploded and perspective views, respectively, of a 2-receptacle connector assembly incorporating receptacle-type connectors of FIGS. 3A, 3B, and 4.

Similar arrangements can be made in connector assemblies of differing construction. In some examples (FIGS. 16 and 17), eight electrical connectors 10 are mounted in a connector insert 22 with seven of the connectors 10 arranged in a substantially regular heptagonal arrangement and with one of the connectors 10 at about the center of the heptagonal arrangement. In the disclosed 7-connector (hexagonal) or 8-connector (heptagonal) arrangements, and in other examples as well, it can be advantageous to arrange the connector insert 22 and the connector housing 20 according to a suitable military or industry standard form factor, e.g., to conform substantially to a MIL-DTL-38999 or MIL-C-38999 specification. Other specifications or arrangements can be employed. Other examples do not have an insert 22 but instead mount the connectors 10 directly in a housing 20. In some examples, two or more connectors 10 can be arranged in a connector housing in a single row (e.g., the example 6 plug and 6-receptacle connector assemblies shown in FIG. 18, or the example 2 receptacle connector assembly of FIGS. 19 and 20). Such single rows may or may not be substantially straight; such single rows may or may not be substantially evenly spaced.

In any type or arrangement of a connector assembly incorporating multiple connectors 10, the connector assembly should be arranged so as to permit engagement with a mating connector assembly in only a single predetermined relative rotational orientation (about a longitudinal axis). That constraint can be achieved in any suitable way, including standard keying or bayonet mounting of the mating connector assemblies, to ensure that correct pairs of connectors 10*a*/10*b* are engaged when the mating assemblies are engaged. Similar indexing of rotational position should be employed for mounting each individual connector 10 in the connector insert 22 or the connector housing 20, to ensure upon engaging mating connector assemblies that each mating connector pair 10*a*/10*b* is properly oriented. If a single connector 10 is to be used alone (i.e., not as one of multiple connectors in a connector assembly), then similar constrains on the rotation of the connector's engagement with a mating connector should be employed to ensure a proper connection is made.

In another set of examples shown in FIGS. 12-15, the connector 10 further comprises an electrically conductive outer shell 150. The outer shell 150 is structurally arranged to circumferentially surround at least a portion of the rear segment 112 of the isolator body 102, the forward portion 122 of the isolator body 102, and the outer insulator 108. The outer shell 150 also is positioned to maintain electrical contact with the rear segment 112 of the isolator body 102. Once the electrically conductive outer shell 150 is in place, it serves as electrical shielding that circumferentially surrounds the forward segment 122 of the isolator body 102 (i.e., that portion from which peripheral electrical shielding was missing). The only remaining gap in the electrical shielding is the thickness of the outer insulator 108 that is between the outer edge of each rib 126 and the inner surface of the outer shell 150. The outer ferrule 110 can be structurally arranged to engage and retain the outer shell 150. Engagement of the outer ferrule 110 with the outer shell 150 results in retention of the inner ferrule 111 on the rearward segment 112 of the isolator body 102. In some examples, both the outer shell 150 and the outer ferrule 110 include threads for engaging each other.

In some examples, instead of threaded engagement of the outer ferrule with the connector insert 22 or the connector housing 20, a forward portion of the outer shell 150 is structurally arranged to engage the connector insert 22 or the connector housing 20. That engagement retains the electrical connector 10 in structural engagement with the connector insert 22 or the connector housing 20. Removing the electrical connector from the connector assembly (e.g., for repair) can be problematic, particularly if deformation of the outer sleeve 150 helps to retain it secured to the connector assembly. In such examples, the connector 10 can further comprise a removal sleeve 152 that circumferentially surrounds a portion of the outer sleeve 150. The removal sleeve 152 is moveable in a forward direction along the outer shell 150. The removal sleeve 152 and the outer shell 150 are structurally arranged so that forward movement of the removal sleeve 152 results in deformation of the forward portion of the outer shell 150. That deformation in turn permits disengagement and removal of the electrical connector 10 from the connector insert 20 or the connector housing 22.

A method for terminating the end of a twisted-pair cable 12 with any of the inventive electrical connectors 10 disclosed herein, or equivalents thereof, comprises: (a) inserting a terminal end of the cable 12 first through the outer ferrule 110 and then through the inner ferrule 111, and sliding the ferrules 110/111 along the cable 12 away from a terminal segment thereof; (b) after step (a), stripping the insulating sheath from the terminal segment of the cable 12, folding back the shielding sheath 14 of the terminal segment of the cable, untwisting the twisted pairs of the wires 16 of the terminal segment of the cable, and stripping forward ends of the wires 16; (c) after step (b), inserting the untwisted portions of each pair of the wires 16 through a corresponding one of the channels 114 through the rearward segment 112 of the isolator body 102; (d) inserting each one of the contacts 106 into the corresponding one of the grooves 146 of the inner insulator 104 and inserting the forward segment of the isolator body 102 into the rearward-facing cavity 141 of the inner insulator 104; (e) after step (c), securing the stripped forward end of each one of the wires 16 within the open rearward end of the corresponding one of the contacts 106; (g) after step (c), unfolding the folded-back terminal segment of the shielding sheath 14 and extending that terminal segment forward around at least a rearward portion of the rearward segment 112 of the isolator body 102; (h) sliding the inner ferrule 111 forward and over at least the rearward portion of the rearward segment 112 of the isolator body 102 with the terminal segment of the shielding sheath 14 between the inner ferrule 111 and the isolator body 102; and (i) sliding the outer ferrule 110 forward and engaging the outer ferrule 110 with an outer shell 150, a connector insert 22, or a connector housing 20 so that the outer ferrule 110 retains the inner ferrule 111 on the rearward segment 112 of the isolator body 102 and urges the inner ferrule 111 inward toward the rearward segment 112 of the isolator body 102 with the forward end of the shielding sheath 14 against the rearward segment 112 of the isolator body 102, thereby retaining the shielding sheath 14 on the rearward segment 112 of the isolator body 102.

One advantage provided by the inventive electrical connectors disclosed herein is the ability to repair or rework the connector 10 if, for example, one contact 106 is damaged. Typically, when one contact is damaged in a conventional connector, the entire connector must be cut off and replaced with a whole new connector. The construction and arrangement of the inventive connectors 10 disclosed herein allow for removal and replacement of individual contacts 106. A method for repairing any of the inventive the electrical connectors 10 disclosed herein comprises: (a) disengaging the outer ferrule 110 from the outer sleeve 150, the connector insert 22, or the connector housing 20 and removing the electrical connector 10 therefrom; (b) after step (a), removing the inner insulator 104, the contacts 106, and the forward segment 122 of the isolator body 102 from the rearward-facing cavity 137 of the outer insulator 108; (c) after step (b), identifying one or more damaged contacts 106, removing the corresponding one or more wires 16 from the one or more damaged contacts 106, and removing the one or more damaged contacts 106 from the corresponding one or more grooves 146; (d) after step (c), securing a stripped forward end of each one of the one or more removed wires 16 into one or more corresponding replacement contacts 106, and inserting the one or more replacement contacts 106 into the corresponding one or more grooves 146; (e) after step (d), inserting the inner insulator 104, the contacts 106, and at least a portion of the forward segment 122 of the isolator body 102 into the rearward-facing cavity 137 of the outer insulator 108; (f) after step (e), sliding the outer ferrule 110 forward and reengaging the outer ferrule 110 with the outer shell 150, the connector insert 22, or the connector housing 20 so that the outer ferrule 110 retains the inner ferrule 111 on the rearward segment 112 of the isolator body 102 and urges the inner ferrule 111 inward toward the rearward segment 112 of the isolator body 102 with the forward end of the shielding sheath 14 against the rearward segment 112 of the isolator body 102, thereby retaining the shielding sheath 14 on the rearward segment 112 of the isolator body 102.

Once mating electrical connectors 10 (e.g., one plug-type connector 10*a* and one receptacle-type connector 10*b*) are installed on the respective ends of two cables 12, those cables can be connected. A method for connecting first and second twisted-pair cables 12 terminated by respective first and second electrical connectors 10*a*/10*b* (which can comprise any of the inventive connectors 10 disclosed herein or equivalents thereof) comprises engaging the first electrical connector 10*a* with the second electrical connector 10*b*, thereby connecting the first and second cables.

In addition to the preceding, the following examples fall within the scope of the present disclosure or appended claims:

EXAMPLE 1

An electrical connector arranged for terminating a cable having an even number 2N of longitudinally extending, individually insulated, electrically conductive wires arranged as N twisted pairs, where N is an integer greater than one, circumferentially surrounded by an electrically conductive shielding sheath that is in turn circumferentially surrounded by an electrically insulating sheath, the electrical connector comprising: (a) an electrically conductive isolator body including a forward segment and a rearward segment, wherein (i) the rearward segment includes N longitudinally extending channels therethrough each having open forward and rearward ends for receiving therethrough an untwisted terminal segment of a corresponding one of the N pairs of wires of the cable, (ii) the forward segment includes a forward-extending central portion and N ribs extending radially from the central portion and extending forward from the rearward segment to a forward end of the connector, and (iii) each one of the ribs separates a corresponding one of the open forward ends of the channels from an adjacent one of the open forward ends so as to enable the untwisted terminal segment of the corresponding pair of wires received through each channel to extend forward between corresponding adjacent ribs; (b) an inner insulator comprising one or more electrically insulating materials and structurally arranged to form (i) a rearward-facing open cavity arranged to receive therein at least a forward portion of the forward segment of the isolator body, (ii) a hole through a forward end wall of the cavity arranged to receive therethrough a forward end of the central portion of the isolator body, (iii) N slots extending radially from the cavity to an outer surface of the inner insulator, each slot being arranged to receive therethrough a corresponding one of the ribs of the isolator body, and (iv) between each adjacent pair of slots on an outer surface of the inner insulator, a pair of longitudinally extending grooves each having open forward and rearward ends; (c) 2N elongated, electrically conductive contacts, wherein each one of the contacts is received in a corresponding one of the grooves of the inner insulator (i) so as to be electrically isolated from the isolator body and the other contacts, and (ii) with an open rearward end of the contact structurally arranged at the open rearward end of the corresponding groove to receive and secure a stripped forward end of a corresponding one of the 2N wires received through the channels; (d) an outer insulator comprising one or more electrically insulating materials structurally arranged to form (i) a rearward-facing open cavity arranged to receive therein at least a portion of the inner insulator, at least a portion of each one of the contacts, and at least the forward portion of the forward segment of the isolator body received within the inner insulator, which are circumferentially surrounded by lateral walls of the cavity, (ii) an opening through the forward end wall of the cavity arranged to receive therethrough the forward end of the central portion of the isolator body and forward ends of the ribs of the isolator body that protrude forward from the outer insulator, and (iii) 2N holes through the forward end wall of the cavity arranged to align with the open forward ends of the grooves of the inner insulator; (e) an inner ferrule structurally arranged to at least partly circumferentially encompass at least a rearward portion of the rearward segment of the isolator body with a forward end of the shielding sheath of the cable between the inner ferrule and the isolator body and in electrical contact with the isolator body; and (f) an outer ferrule structurally arranged to retain the inner ferrule on the rearward segment of the isolator body and to urge the inner ferrule inward toward the rearward segment of the isolator body with the forward end of the shielding sheath against the rearward segment of the isolator body, thereby retaining the shielding sheath on the rearward segment of the isolator body.

EXAMPLE 2

The electrical connector of Example 1 wherein the isolator body comprises one or more metals of metal alloys.

EXAMPLE 3

The electrical connector of any one of Examples 1 or 2 wherein the isolator body comprises an electrically insulating material and an electrically conductive coating.

EXAMPLE 4

The electrical connector of any one of Examples 1-3 wherein the isolator body comprises: aluminum, stainless steel, beryllium copper, other suitable metal(s) or alloy(s); polyetherimide, polyether ether ketone (PEEK), or other thermoplastic with electroless nickel or copper plating).

EXAMPLE 5

The electrical connector of any one of Examples 1-4 wherein the inner insulator or the outer insulator comprises polyetherimide (Ultem®), polyether ether ketone (PEEK), or polytetrafluoroethylene (PTFE or Teflon®).

EXAMPLE 6

The electrical connector of any one of Examples 1-5 wherein N=4.

EXAMPLE 7

The electrical connector of any one of Examples 1-6 wherein each of the contacts comprises one or more metals or metal alloys.

EXAMPLE 8

The electrical connector of any one of Examples 1-7 wherein each of the contacts comprises one or more metals or metal alloys, such as copper, leaded nickel copper, beryllium copper, CuCrZr alloys, or gold- or silver-plated aluminum.

EXAMPLE 9

The electrical connector of any one of Examples 1-8 wherein each one of the contacts comprises an elongated pin contact that is structurally arranged to protrude through the corresponding hole in the outer insulator and protrude forward from the outer insulator so that the electrical connector is arranged as a plug-type connector.

EXAMPLE 10

The electrical connector of any one of Examples 1-9 wherein each one of the contacts comprises an elongated socket contact with an open forward end structurally arranged at the corresponding hole in the outer insulator to receive a corresponding pin, of a mating plug-type connector, inserted through the corresponding hole so that the electrical connector is arranged as a receptacle-type connector.

EXAMPLE 11

The electrical connector of any one of Examples 1-10 wherein each one of the contacts is retained in the corresponding groove of the inner insulator by a snap fit, press fit, or interference fit.

EXAMPLE 12

The electrical connector of any one of Examples 1-11 wherein the rearward segment has an outer surface with a knurled rearward portion arranged to engage the shielding sheath of the cable.

EXAMPLE 13

The electrical connector of any one of Examples 1-12 wherein the rearward segment of the isolator body and the inner ferrule are structurally arranged so as to engage each other to limit or prevent rotation about a longitudinal axis of the inner ferrule relative to the isolator body.

EXAMPLE 14

The electrical connector of any one of Examples 1-13 wherein the inner ferrule or the outer ferrule comprises one or more metals or metal alloys.

EXAMPLE 15

The electrical connector of any one of Examples 1-14 wherein the inner ferrule or the outer ferrule comprises beryllium copper, aluminum, stainless steel, or polyetherimide or polyether ether ketone (PEEK) with electroless nickel or copper plating.

EXAMPLE 16

The electrical connector of any one of Examples 1-15 wherein the outer ferrule is structurally arranged to engage and retain a forward end of the insulating sheath of the cable.

EXAMPLE 17

The electrical connector of any one of Examples 1-16 wherein the outer ferrule is structurally arranged to engage a connector insert or a connector housing of a connector assembly so as to retain the electrical connector in structural engagement with the connector insert or the connector housing.

EXAMPLE 18

The electrical connector of Example 17 wherein engagement of the outer ferrule with the connector insert or connector housing results in retention of the inner ferrule on the rearward segment of the isolator body.

EXAMPLE 19

The electrical connector of any one of Examples 17 or 18 wherein the outer ferrule includes threads for engaging the connector insert or the connector housing.

EXAMPLE 20

The electrical connector of any one of Examples 1-19 further comprising an electrically conductive outer shell structurally arranged to circumferentially surround at least a portion of the rear segment of the isolator body, the forward portion of the isolator body, and the outer insulator, and to maintain electrical contact with the rear segment of the isolator body.

EXAMPLE 21

The electrical connector of Example 20 wherein the outer ferrule is structurally arranged to engage and retain the outer shell, and engagement of the outer ferrule with the outer shell results in retention of the inner ferrule on the rearward segment of the isolator body.

EXAMPLE 22

The electrical connector of Example 21 wherein both the outer shell and the outer ferrule include threads for engaging each other.

EXAMPLE 23

The electrical connector of any one of Examples 20-22 further comprising a removal sleeve structurally arranged to circumferentially surround a portion of the outer sleeve and to be moveable in a forward direction along the outer shell, wherein: (i) a forward portion of the outer shell is structurally arranged to engage a connector insert or a connector housing of a connector assembly so as to retain the electrical connector in structural engagement with the connector insert or the connector housing; and (ii) the removal sleeve and the outer shell are structurally arranged so that forward movement of the removal sleeve results in deformation of a forward portion of the outer shell that permits disengagement and removal of the electrical connector from the connector insert or the connector housing.

EXAMPLE 24

The electrical connector of any one of Examples 17-19 or 23 wherein the electrical connector is structurally adapted so as to engage the connector assembly in only a single predetermined rotational orientation about a longitudinal axis relative to the connector assembly.

EXAMPLE 25

The electrical connector of any one of Examples 1-24 wherein the electrical connector is structurally adapted so as to engage a mating electrical connector in only a single predetermined rotational orientation about a longitudinal axis relative to the mating electrical connector.

EXAMPLE 26

The electrical connector of any one of Examples 1-25 further comprising a length of shrink tubing or one or more O-rings structurally arranged so as to substantially seal a forward end of the insulating sheath of the cable or a rearward end of the outer ferrule.

EXAMPLE 27

A connector assembly comprising a connector housing and two or more of the electrical connectors of any one of Examples 1-26 mounted in the connector housing in a substantially parallel, spaced apart, substantially flush arrangement.

EXAMPLE 28

The connector assembly of Example 27 wherein three or more of the electrical connectors are mounted in the connector housing in a single row.

EXAMPLE 29

The connector assembly of Example 27 wherein (i) seven of the electrical connectors are mounted in an electrically conductive connector insert with six of the connectors arranged in a substantially regular hexagonal arrangement and with one of the connectors at about the center of the hexagonal arrangement, and (ii) the connector insert is mounted within the connector housing.

EXAMPLE 30

The connector assembly of Example 27 wherein (i) eight of the electrical connectors are mounted in an electrically conductive connector insert with seven of the connectors arranged in a substantially regular heptagonal arrangement and with one of the connectors at about the center of the heptagonal arrangement, and (ii) the connector insert is mounted within the connector housing.

EXAMPLE 31

The connector assembly of any one of Examples 29 or 30 wherein the connector insert and the connector housing substantially conform to a MIL-DTL-38999 specification or a MIL-C-38999 specification.

EXAMPLE 32

The connector assembly of any one of Examples 27-31 wherein the connector assembly is structurally adapted so as to engage a mating connector assembly in only a single predetermined rotational orientation about a longitudinal axis relative to the mating connector assembly.

EXAMPLE 33

A method for terminating, with the electrical connector of any one of Examples 1-26, a cable having an even number 2N of longitudinally extending, individually insulated, electrically conductive wires arranged as N twisted pairs, where N is an integer greater than one, circumferentially surrounded by an electrically conductive shielding sheath that is in turn circumferentially surrounded by an electrically insulating sheath, the method comprising: (a) inserting a terminal end of the cable first through the outer ferrule and then through the inner ferrule, and sliding the outer and inner ferrules along the cable away from a terminal segment thereof; (b) after step (a), stripping the insulating sheath from the terminal segment of the cable, folding back the shielding sheath of the terminal segment of the cable, untwisting the twisted pairs of the wires of the terminal segment of the cable, and stripping forward ends of the wires; (c) after step (b), inserting the untwisted portions of each pair of the wires through a corresponding one of the channels through the rearward segment of the isolator body; (d) inserting each one of the contacts into the corresponding one of the grooves of the inner insulator and inserting the forward segment of the isolator body into the rearward-facing cavity of the inner insulator; (e) after step (c), securing the stripped forward end of each one of the wires within the open rearward end of the corresponding one of the contacts; (g) after step (c), unfolding the folded-back terminal segment of the shielding sheath and extending that terminal segment forward around at least a rearward portion of the rearward segment of the isolator body; (h) sliding the inner ferrule forward and over at least the rearward portion of the rearward segment of the isolator body with the terminal segment of the shielding sheath between the inner ferrule and the isolator body; and (i) sliding the outer ferrule forward and engaging the outer ferrule with an outer shell, a connector insert, or a connector housing so that the outer ferrule retains the inner ferrule on the rearward segment of the isolator body and urges the inner ferrule inward toward the rearward segment of the isolator body with the forward end of the shielding sheath against the rearward segment of the isolator body, thereby retaining the shielding sheath on the rearward segment of the isolator body.

EXAMPLE 34

A method for repairing the electrical connector of any one of Examples 1-26 attached to and terminating a cable having an even number 2N of longitudinally extending, individually insulated, electrically conductive wires arranged as N twisted pairs, where N is an integer greater than one, circumferentially surrounded by an electrically conductive shielding sheath that is in turn circumferentially surrounded by an electrically insulating sheath, the method comprising: (a) disengaging the outer ferrule from the outer sleeve, the connector insert, or the connector housing and removing the electrical connector therefrom; (b) after step (a), removing the inner insulator, the contacts, and the forward segment of the isolator body from the rearward-facing cavity of the outer insulator; (c) after step (b), identifying one or more damaged contacts, removing the corresponding one or more wires from the one or more damaged contacts, and removing the one or more damaged contacts from the corresponding one or more grooves; (d) after step (c), securing a stripped forward end of each one of the one or more removed wires into one or more corresponding replacement contacts, and inserting the one or more replacement contacts into the corresponding one or more grooves; (e) after step (d), inserting the inner insulator, the contacts, and at least a portion of the forward segment of the isolator body into the rearward-facing cavity of the outer insulator; (f) after step (e), sliding the outer ferrule forward and reengaging the outer ferrule with the outer shell, the connector insert, or the connector housing forward so that the outer ferrule retains the inner ferrule on the rearward segment of the isolator body and urges the inner ferrule inward toward the rearward segment of the isolator body with the forward end of the shielding sheath against the rearward segment of the isolator body, thereby retaining the shielding sheath on the rearward segment of the isolator body.

EXAMPLE 35

A method for connecting first and second cables terminated by respective first and second electrical connectors, wherein: (a) each cable has an even number 2N of longitudinally extending, individually insulated, electrically conductive wires arranged as N twisted pairs, where N is an integer greater than one, circumferentially surrounded by an electrically conductive shielding sheath that is in turn circumferentially surrounded by an electrically insulating sheath; (b) the first electrical connector comprises the electrical connector of any one of Examples 1-9 or 11-26 arranged as a plug-type connector, and the second electrical connector comprises the electrical connector of any one of Examples 1-8 or 10-26 arranged as a receptacle-type connector; and (c) the method comprises engaging the first electrical connector with the second electrical connector, thereby connecting the first and second cables.

It is intended that equivalents of the disclosed example embodiments and methods shall fall within the scope of the present disclosure or appended claims. It is intended that the disclosed example embodiments and methods, and equivalents thereof, may be modified while remaining within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed example embodiment. Thus, the appended claims are hereby incorporated into the Detailed Description, with each claim standing on its own as a separate disclosed embodiment. However, the present disclosure shall also be construed as implicitly disclosing any embodiment having any suitable set of one or more disclosed or claimed features (i.e., a set of features that are neither incompatible nor mutually exclusive) that appear in the present disclosure or the appended claims, including those sets that may not be explicitly disclosed herein. In addition, for purposes of disclosure, each of the appended dependent claims shall be construed as if written in multiple dependent form and dependent upon all preceding claims with which it is not inconsistent. It should be further noted that the scope of the appended claims does not necessarily encompass the whole of the subject matter disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure and appended claims, the words "comprising," "including," "having," and variants thereof, wherever they appear, shall be construed as open ended terminology, with the same meaning as if the phrase "at least" were appended after each instance thereof, unless explicitly stated otherwise.

In the appended claims, if the provisions of 35 USC §112 (f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC §112(f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. An electrical connector arranged for terminating a cable having an even number 2N of longitudinally extending, individually insulated, electrically conductive wires arranged as N twisted pairs, where N is an integer greater than one, circumferentially surrounded by an electrically conductive shielding sheath that is in turn circumferentially surrounded by an electrically insulating sheath, the electrical connector comprising:

(a) an electrically conductive isolator body including a forward segment and a rearward segment, wherein (i) the rearward segment includes N longitudinally extending channels therethrough each having open forward and rearward ends for receiving therethrough an untwisted terminal segment of a corresponding one of the N pairs of wires of the cable, (ii) the forward segment includes a forward-extending central portion and N ribs extending radially from the central portion and extending forward from the rearward segment to a forward end of the connector, and (iii) each one of the ribs separates a corresponding one of the open forward ends of the channels from an adjacent one of the open forward ends so as to enable the untwisted terminal segment of the corresponding pair of wires received through each channel to extend forward between corresponding adjacent ribs;

(b) an inner insulator comprising one or more electrically insulating materials and structurally arranged to form (i) a rearward-facing open cavity arranged to receive therein at least a forward portion of the forward segment of the isolator body, (ii) a hole through a forward end wall of the cavity arranged to receive therethrough a forward end of the central portion of the isolator body, (iii) N slots extending radially from the cavity to an outer surface of the inner insulator, each slot being arranged to receive therethrough a corresponding one of the ribs of the isolator body, and (iv) between each adjacent pair of slots on an outer surface of the inner insulator, a pair of longitudinally extending grooves each having open forward and rearward ends;

(c) 2N elongated, electrically conductive contacts, wherein each one of the contacts is received in a corresponding one of the grooves of the inner insulator (i) so as to be electrically isolated from the isolator body and the other contacts, and (ii) with an open rearward end of the contact structurally arranged at the open rearward end of the corresponding groove to receive and secure a stripped forward end of a corresponding one of the 2N wires received through the channels;

(d) an outer insulator comprising one or more electrically insulating materials structurally arranged to form (i) a rearward-facing open cavity arranged to receive therein at least a portion of the inner insulator, at least a portion of each one of the contacts, and at least the forward portion of the forward segment of the isolator body received within the inner insulator, which are circumferentially surrounded by lateral walls of the cavity, (ii) an opening through the forward end wall of the cavity arranged to receive therethrough the forward end of the central portion of the isolator body and forward ends of the ribs of the isolator body that protrude forward from the outer insulator, and (iii) 2N holes through the forward end wall of the cavity arranged to align with the open forward ends of the grooves of the inner insulator;

(e) an inner ferrule structurally arranged to at least partly circumferentially encompass at least a rearward portion of the rearward segment of the isolator body with a forward end of the shielding sheath of the cable between the inner ferrule and the isolator body and in electrical contact with the isolator body; and (f) an outer ferrule structurally arranged to retain the inner ferrule on the rearward segment of the isolator body and to urge the inner ferrule inward toward the rearward segment of the isolator body with the forward end of the shielding sheath against the rearward segment of the isolator body, thereby retaining the shielding sheath on the rearward segment of the isolator body.

2. The electrical connector of claim 1 wherein the isolator body comprises one or more metals or metal alloys.

3. The electrical connector of claim 1 wherein N=4.

4. The electrical connector of claim 1 wherein each of the contacts comprises one or more metals or metal alloys.

5. The electrical connector of claim 1 wherein each one of the contacts comprises an elongated pin contact that is structurally arranged to protrude through the corresponding hole in the outer insulator and protrude forward from the outer insulator so that the electrical connector is arranged as a plug-type connector.

6. The electrical connector of claim 1 wherein each one of the contacts comprises an elongated socket contact with an open forward end structurally arranged at the corresponding hole in the outer insulator to receive a corresponding pin, of a mating plug-type connector, inserted through the corresponding hole so that the electrical connector is arranged as a receptacle-type connector.

7. The electrical connector of claim 1 wherein each one of the contacts is retained in the corresponding groove of the inner insulator by a snap fit, press fit, or interference fit.

8. The electrical connector of claim 1 wherein the rearward segment has an outer surface with a knurled rearward portion arranged to engage the shielding sheath of the cable.

9. The electrical connector of claim 1 wherein the rearward segment of the isolator body and the inner ferrule are structurally arranged so as to engage each other to limit or prevent rotation about a longitudinal axis of the inner ferrule relative to the isolator body.

10. The electrical connector of claim 1 wherein the inner ferrule or the outer ferrule comprises one or more metals or metal alloys.

11. The electrical connector of claim 1 wherein the outer ferrule is structurally arranged to engage and retain a forward end of the insulating sheath of the cable.

12. The electrical connector of claim 1 wherein the outer ferrule is structurally arranged to engage a connector insert or a connector housing of a connector assembly so as to retain the electrical connector in structural engagement with the connector insert or the connector housing.

13. The electrical connector of claim 12 wherein engagement of the outer ferrule with the connector insert or connector housing results in retention of the inner ferrule on the rearward segment of the isolator body.

14. The electrical connector of claim 12 wherein the electrical connector is structurally adapted so as to engage the connector assembly in only a single predetermined rotational orientation about a longitudinal axis relative to the connector assembly.

15. The electrical connector of claim 1 further comprising an electrically conductive outer shell structurally arranged to circumferentially surround at least a portion of the rear segment of the isolator body, the forward portion of the isolator body, and the outer insulator, and to maintain electrical contact with the rear segment of the isolator body.

16. The electrical connector of claim 15 wherein the outer ferrule is structurally arranged to engage and retain the outer shell, and engagement of the outer ferrule with the outer shell results in retention of the inner ferrule on the rearward segment of the isolator body.

17. The electrical connector of claim 15 further comprising a removal sleeve structurally arranged to circumferentially surround a portion of the outer sleeve and to be moveable in a forward direction along the outer shell, wherein:

(i) a forward portion of the outer shell is structurally arranged to engage a connector insert or a connector housing of a connector assembly so as to retain the electrical connector in structural engagement with the connector insert or the connector housing; and (ii) the removal sleeve and the outer shell are structurally arranged so that forward movement of the removal sleeve results in deformation of a forward portion of the outer shell that permits disengagement and removal of the electrical connector from the connector insert or the connector housing.

18. The electrical connector of claim 1 wherein the electrical connector is structurally adapted so as to engage a mating electrical connector in only a single predetermined rotational orientation about a longitudinal axis relative to the mating electrical connector.

19. The electrical connector of claim 1 further comprising a length of shrink tubing or one or more O-rings structurally arranged so as to substantially seal a forward end of the insulating sheath of the cable or a rearward end of the outer ferrule.

20. A connector assembly comprising a connector housing and two or more of the electrical connectors of claim 1 mounted in the connector housing in a substantially parallel, spaced apart, substantially flush arrangement.

21. The connector assembly of claim 20 wherein two or more of the electrical connectors are mounted in the connector housing in a single row.

22. The connector assembly of claim 20 wherein (i) seven of the electrical connectors are mounted in a connector insert with six of the connectors arranged in a substantially regular hexagonal arrangement and with one of the connectors at about the center of the hexagonal arrangement, and (ii) the connector insert is mounted within the connector housing.

23. The connector assembly of claim 20 wherein (i) eight of the electrical connectors are mounted in a connector insert with seven of the connectors arranged in a substantially regular heptagonal arrangement and with one of the connectors at about the center of the heptagonal arrangement, and (ii) the connector insert is mounted within the connector housing.

24. The connector assembly of claim 20 wherein the connector insert and the connector housing substantially conform to a MIL-DTL-38999 specification or a MIL-C-38999 specification.

25. The connector assembly of claim 20 wherein the connector assembly is structurally adapted so as to engage a mating connector assembly in only a single predetermined rotational orientation about a longitudinal axis relative to the mating connector assembly.

26. A method for terminating, with the electrical connector of claim 1, a cable having an even number 2N of longitudinally extending, individually insulated, electrically conductive wires arranged as N twisted pairs, where N is an integer greater than one, circumferentially surrounded by an electrically conductive shielding sheath that is in turn circumferentially surrounded by an electrically insulating sheath, the method comprising:

(a) inserting a terminal end of the cable first through the outer ferrule and then through the inner ferrule, and sliding the outer and inner ferrules along the cable away from a terminal segment thereof;

(b) after step (a), stripping the insulating sheath from the terminal segment of the cable, folding back the shielding sheath of the terminal segment of the cable, untwisting the twisted pairs of the wires of the terminal segment of the cable, and stripping forward ends of the wires;

(c) after step (b), inserting the untwisted portions of each pair of the wires through a corresponding one of the channels through the rearward segment of the isolator body;

(d) inserting each one of the contacts into the corresponding one of the grooves of the inner insulator and inserting the forward segment of the isolator body into the rearward-facing cavity of the inner insulator;

(e) after step (c), securing the stripped forward end of each one of the wires within the open rearward end of the corresponding one of the contacts;

(g) after step (c), unfolding the folded-back terminal segment of the shielding sheath and extending that terminal segment forward around at least a rearward portion of the rearward segment of the isolator body;

(h) sliding the inner ferrule forward and over at least the rearward portion of the rearward segment of the isolator body with the terminal segment of the shielding sheath between the inner ferrule and the isolator body; and (i) sliding the outer ferrule forward and engaging the outer ferrule with an outer shell, a connector insert, or a connector housing so that the outer ferrule retains the inner ferrule on the rearward segment of the isolator body and urges the inner ferrule inward toward the rearward segment of the isolator body with the forward end of the shielding sheath against the rearward segment of the isolator body, thereby retaining the shielding sheath on the rearward segment of the isolator body.

27. A method for repairing the electrical connector of claim 1 attached to and terminating a cable having an even number 2N of longitudinally extending, individually insulated, electrically conductive wires arranged as N twisted pairs, where N is an integer greater than one, circumferentially surrounded by an electrically conductive shielding sheath that is in turn circumferentially surrounded by an electrically insulating sheath, the method comprising:

(a) disengaging the outer ferrule from the outer sleeve, the connector insert, or the connector housing and removing the electrical connector therefrom;

(b) after step (a), removing the inner insulator, the contacts, and the forward segment of the isolator body from the rearward-facing cavity of the outer insulator;

(c) after step (b), identifying one or more damaged contacts, removing the corresponding one or more wires from the one or more damaged contacts, and removing the one or more damaged contacts from the corresponding one or more grooves;

(d) after step (c), securing a stripped forward end of each one of the one or more removed wires into one or more corresponding replacement contacts, and inserting the one or more replacement contacts into the corresponding one or more grooves;

(e) after step (d), inserting the inner insulator, the contacts, and at least a portion of the forward segment of the isolator body into the rearward-facing cavity of the outer insulator;

(f) after step (e), sliding the outer ferrule forward and reengaging the outer ferrule with the outer shell, the connector insert, or the connector housing forward so that the outer ferrule retains the inner ferrule on the rearward segment of the isolator body and urges the inner ferrule inward toward the rearward segment of the isolator body with the forward end of the shielding sheath against the rearward segment of the isolator body, thereby retaining the shielding sheath on the rearward segment of the isolator body.

28. A method for connecting first and second cables terminated by respective first and second electrical connectors of claim 1, wherein:

(a) each cable has an even number 2N of longitudinally extending, individually insulated, electrically conductive wires arranged as N twisted pairs, where N is an integer greater than one, circumferentially surrounded by an electrically conductive shielding sheath that is in turn circumferentially surrounded by an electrically insulating sheath;

(b) the first electrical connector comprises an electrical connector of claim 1 arranged as a plug-type connector, and the second electrical connector comprises an electrical connector of claim 1 arranged as a receptacle-type connector; and (c) the method comprises engaging the first electrical connector with the second electrical connector, thereby connecting the first and second cables.

* * * * *